US007591653B2

(12) United States Patent
Boileau et al.

(10) Patent No.: US 7,591,653 B2
(45) Date of Patent: Sep. 22, 2009

(54) MODULAR POWER DISTRIBUTION CENTER

(75) Inventors: Daniel E. Boileau, Romulus, MI (US); Ankoor Bagchi, Chicago, IL (US); Nathan Like, Westland, MI (US); Robert J. Young, Flat Rock, MI (US)

(73) Assignee: AEES, Inc., Farmington Hills, MI (US)

( * ) Notice: Subject to any disclaimer, the term of this patent is extended or adjusted under 35 U.S.C. 154(b) by 0 days.

(21) Appl. No.: 11/850,519

(22) Filed: Sep. 5, 2007

(65) Prior Publication Data

US 2008/0153325 A1 Jun. 26, 2008

Related U.S. Application Data

(60) Provisional application No. 60/825,020, filed on Sep. 8, 2006.

(51) Int. Cl.
*H01R 12/00* (2006.01)

(52) U.S. Cl. ..... 439/76.2

(58) Field of Classification Search ..... 439/76.2, 439/75, 949, 76.1; 361/747, 739, 750–752, 361/760–764; 257/691, 698; 174/59, 260, 174/262, 267

See application file for complete search history.

(56) References Cited

U.S. PATENT DOCUMENTS

| | | | |
|---|---|---|---|
| 4,545,632 | A | 10/1985 | Maier et al. |
| 4,638,175 | A | 1/1987 | Bradford et al. |
| 4,689,718 | A | 8/1987 | Maue et al. |
| RE33,087 | E | 10/1989 | Bradford et al. |
| 5,038,050 | A | 8/1991 | Minoura |
| 5,057,026 | A | 10/1991 | Sawai et al. |
| 5,179,503 | A | 1/1993 | Fouts et al. |
| 5,295,842 | A | 3/1994 | Ozaki et al. |
| 5,438,310 | A | 8/1995 | Ikari |
| 5,643,693 | A | 7/1997 | Hill et al. |
| 5,655,927 | A | 8/1997 | Maue et al. |
| 5,735,713 | A | 4/1998 | Sugiura |
| 5,763,827 | A | 6/1998 | Sugiura |
| 5,764,487 | A | 6/1998 | Natsume |
| 5,777,843 | A | 7/1998 | Younce |
| 5,785,532 | A | 7/1998 | Maue et al. |
| 5,795,193 | A | 8/1998 | Yang |
| 5,995,380 | A | 11/1999 | Maue et al. |
| 6,015,302 | A | 1/2000 | Butts et al. |
| 6,016,253 | A | 1/2000 | Seitz et al. |
| 6,022,247 | A | 2/2000 | Akiyama et al. |
| 6,045,412 | A | 4/2000 | Guanco et al. |
| 6,126,458 | A | 10/2000 | Gregory, II et al. |
| 6,150,734 | A | 11/2000 | Neibecker et al. |
| 6,178,106 | B1 | 1/2001 | Umemoto et al. |
| 6,181,101 | B1 | 1/2001 | Arai et al. |

(Continued)

OTHER PUBLICATIONS

PCT International Search Report and Written Opinion mailed on Apr. 25, 2008 in connection with International Appln. No. PCT/US2007/080409.

*Primary Examiner*—Alexander Gilman
(74) *Attorney, Agent, or Firm*—Howard & Howard Attorneys PLLC

(57) ABSTRACT

There is disclosed a modular power distribution center that utilizes connectors for interconnectivity, as opposed to hard wiring and allows for the integration of electronics modules onto printed circuit board architecture.

39 Claims, 33 Drawing Sheets

U.S. PATENT DOCUMENTS 6,191,558 B1 2/2001 Arai et al.
6,208,931 B1 3/2001 Schoettle et al.
6,247,973 B1 6/2001 Chawa et al.
6,301,528 B1 10/2001 Bertram et al.
6,350,949 B1 2/2002 Boyd
6,356,424 B1 3/2002 Myong et al.
6,409,525 B1 6/2002 Hoelscher et al.
6,419,522 B1 7/2002 Bonilla
6,424,900 B2 7/2002 Murray et al.
6,434,009 B1 8/2002 Culp
6,445,592 B1 9/2002 Schirmer
6,496,377 B1 12/2002 Happ et al.
6,507,506 B1 1/2003 Pinas et al.
6,583,353 B2 6/2003 Murakoshi et al.
6,642,633 B1 11/2003 Yang
6,679,344 B1 1/2004 Bertram et al.
6,762,595 B2 7/2004 Tamai et al.
6,832,930 B2 12/2004 Kubota et al.
6,833,503 B2 12/2004 Lopez et al.
6,848,946 B2 2/2005 Vicenza et al.
6,850,421 B2 2/2005 Boyd
6,879,057 B1 4/2005 Pinas et al.
6,884,090 B2 4/2005 Kubota
6,890,196 B2 5/2005 Vila
6,894,891 B2 5/2005 Darr et al.
6,896,536 B1 5/2005 Nguyen et al.
6,901,326 B2 5/2005 Bolz et al.
6,922,331 B2 7/2005 Ikeda
6,923,660 B2 8/2005 Takeuchi
6,955,544 B2 10/2005 Miquel et al.
6,971,888 B2 * 12/2005 Takeuchi et al. ..... 439/76.2
7,037,124 B2 5/2006 Lee et al.
7,107,183 B2 9/2006 Alonso
7,112,101 B2 9/2006 Pedret et al.
7,116,009 B2 10/2006 Tamai et al.
7,119,456 B2 10/2006 Rouleau
7,125,262 B2 * 10/2006 Saka ..... 439/76.2
7,134,893 B1 11/2006 Kalisz et al.
7,164,272 B1 1/2007 Borrego Bel et al.
7,180,157 B2 1/2007 Jones, III et al.
7,176,585 B2 2/2007 Fehr
7,189,081 B2 3/2007 Tanaka et al.
7,235,898 B1 6/2007 Jones, III et al.
7,275,649 B2 10/2007 Palau
7,291,024 B2 11/2007 Kiyota et al.
7,291,025 B2 11/2007 Yagi et al.
7,294,000 B2 11/2007 Vera et al.
7,303,405 B2 12/2007 Ikeda et al.
7,314,376 B2 1/2008 Yagi et al.
7,315,094 B2 1/2008 Runge et al.
2002/0149261 A1 10/2002 Vierling et al.
2003/0030328 A1 2/2003 Tamai et al.
2004/0067691 A1 4/2004 Vicenza et al.
2004/0163858 A1 8/2004 Borrego Bel et al.
2004/0253864 A1 12/2004 Roset Rubio et al.
2005/0000960 A1 1/2005 Bergeret
2005/0002140 A1 1/2005 Borrego Bel et al.
2005/0059280 A1 3/2005 Hobbs et al.
2005/0085101 A1 4/2005 Chengalva
2005/0106911 A1 5/2005 Sharples et al.
2005/0130460 A1 6/2005 Koyota et al.
2005/0201030 A1 9/2005 Toth
2006/0141822 A1 6/2006 Ozawa et al.
2006/0141824 A1 6/2006 Kubota et al.
2006/0158832 A1 7/2006 Ferran Palau
2006/0238938 A1 10/2006 Shaya et al.
2007/0075677 A1 4/2007 Alvarez-Troncoso
2007/0076354 A1 4/2007 Kato et al.
2007/0091547 A1 4/2007 Murakami
2007/0134944 A1 6/2007 Tiesler et al.
2007/0148993 A1 6/2007 Suzuki
2007/0167040 A1 7/2007 Ogawa et al.
2007/0205663 A1 9/2007 Byrne
2007/0207639 A1 9/2007 Kinoshita et al.
2007/0216225 A1 9/2007 Fernandez et al.
2007/0249189 A1 10/2007 Kaneko et al.
2007/0254533 A1 * 11/2007 Kinoshita et al. ..... 439/709
2007/0270033 A1 11/2007 Yoshida et al.
2007/0277999 A1 12/2007 Ishida et al.
2007/0279842 A1 12/2007 Ishida et al.
2007/0279870 A1 12/2007 Sato et al.
2007/0279871 A1 12/2007 Ishida et al.

* cited by examiner

MODULAR POWER DISTRIBUTION CENTER

This application claims the benefit of Provisional Application Ser. No. 60/825,020, filed Sep. 8, 2006.

FIELD OF THE INVENTION

This invention relates generally to an electrical power distribution center and more particularly to method and apparatus for distributing electrical power in a vehicle.

BACKGROUND OF THE INVENTION

The first motorized vehicles had little in the way of an electrical system. All that was required was some way to generate and distribute an ignition potential to each of the cylinders of the small, internal combustion engine that powered these early vehicles. The need to see the road ahead during nighttime operation gave rise to the first electrical accessory: headlights. Interior illumination was added for the operator's convenience, and a single tail light was considered adequate. Turn signal lights followed, but the simple vehicle radio receiver did not make its appearance until a number of years later. The modern automobile is an impressive collection of electrical hardware: from stereo sound equipment to air conditioning; from power windows, mirrors and seats to keyless entry systems; from vehicle alarms to seat position memory to electrically heated seats. The complexity of vehicle electrical systems has grown almost exponentially since the automobile's introduction.

An automotive electrical system is a formidable combination of high-current and low-current circuitry. In many cases, relays are required for control purposes, and all circuits must be adequately fused to protect expensive components and to guard against the danger of fire. In order to facilitate the replacement of fuses and relays, and to simplify interconnection of electrical hardware, many different electric power distribution systems have been tried.

One approach that has been tried with fair consistency is to centralize the mounting of fuses and relays and then route input and output connections from this central location. The first systems built using this approach included a great deal of point-to-point wiring. Hand wiring is very costly, and manual wiring operations are a source of wiring errors that negatively impact product quality. Another approach has been the construction of customized distribution networks stamped from thin metal sheets. These stampings are then shaped so that contact tabs protrude through openings in custom designed plastic shells. Although this approach typically yields a higher quality product, tooling costs can be high for both the plastic shells and the stampings since virtually every automobile model requires a unique distribution system. At least some of this uniqueness aspect is driven by the proliferation of fuse and relay packages. A distribution product must be able to accommodate the fuse and relay components selected by the manufacturer.

Another approach centered around the use of flexible circuit board technology, or "flex circuits." Flex circuits are constructed by depositing conductive material between two flexible insulating layers. Although the unique distribution requirements of each vehicle model would require unique flex circuits for each application, tooling costs are much lower than the metal stamping/custom plastic housing approach described previously. The principal disadvantage of the flex circuit approach is that the conductive layers are very thin, and the high current densities required in vehicle power distribution can lead to overheating and possible eventual failure.

In summary, existing modular power distribution centers are hard wired and do not allow for modular integration of electronics. Consequently, a need arises for a vehicle electric power distribution system that can be customized for a particular vehicle with relative ease, that avoids high tooling costs for custom designed components, that is reliable in a high current environment, that will accommodate a wide range of fuse and relay packages, and that is relatively inexpensive to manufacture.

SUMMARY OF THE INVENTION

The present invention relates to a modular power distribution center that utilizes connectors for interconnectivity, as opposed to hard wiring and allows for the integration of electronics modules onto printed circuit board architecture. Broadly, the power distribution center can include:

a modular housing having at least one receptacle for engaging a device and at least one socket for I/O connections;

at least one printed circuit board within the modular housing which can comprise at least one I/O connection which corresponds to at least one socket for I/O connections of the modular housing, the printed circuit board being electrically connected to at least one primary buss or the at least one primary buss being integrated into the printed circuit board; and the at least one primary buss having a primary conductive strip, a terminal connected to the primary conductive strip and at least one device interface buss connected to the primary conductive strip, wherein connections to the at least one device interface buss correspond with the at least one receptacle of the modular housing.

The modular housing of the power distribution center can include any material that will provide structural integrity for the assembly such as, for example, side walls of plastic, extruded aluminum, etc.; an upper face and a lower face wherein either face can include at least one plate having a grid of receptacle portions defined through the face of the at least one plate, wherein the receptacle portions correspond to connections of the device interface buss; and the other face can include at least one connector module, or is adapted to connect to a remote module, and having at least one socket that corresponds to the I/O connections of the printed circuit board. All connection can be made through either one or both faces. The receptacle portions can be configured to receive in engaging fashion electrical devices including, but not limited to: fuses, relays, resistors, diodes, and switches. The at least one printed circuit board of the modular power distribution center can include a single printed circuit board or two boards. When two printed circuit boards are present, the printed circuit board are electrically coupled to each other, either board can include or provide power distribution from the at least one primary buss, and either can provide electrical connections to the at least one I/O connection.

A method for distributing electrical power in a vehicle is disclosed which includes at least one device interface buss having device connections, at least one printed circuit board, and a modular housing which provides a degree of adjustability that is unavailable in prior power distribution centers. The method for distributing electrical power in a vehicle comprises the steps of:

providing a power buss having a positive battery terminal and at least one device interface buss having device connections;

connecting the power buss to at least one printed circuit board, wherein the at least one printed circuit board has at least one I/O connection; and enclosing the printed circuit board within a housing comprising at least one modular plate having a grid of receptacle portions corresponding to the device connections of the at least one device interface buss and at least one socket corresponding to the at least one I/O connection of the printed circuit board.

In one embodiment, the power buss includes a primary buss strip having a length along a first direction selected to provide electrical connections to at least the portion of the housing corresponding to the connections of the electrical devices; connecting the battery positive terminal to the primary buss strip or to the printed circuit board; and connecting at least one device interface buss to a portion of the primary buss strip, wherein the at least one device interface buss has a length along a second direction and is connected to a portion of the primary buss strip to provide connections to the electrical devices.

Enclosing the circuit board within the housing may further include providing a modular upper plate and a modular lower plate as a repeatable unit. The number of the modular upper plates corresponds to the electrical device connections to the device interface buss and the device connections to the power distribution center. The number of the modular lower plates corresponds to the I/O connections of the printed circuit board and the I/O connections to the power distribution center.

The foregoing has outlined, rather broadly, the features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. While the present invention is embodied in hardware, alternate equivalent embodiments may be employed. Those skilled in the art should realize that such equivalent constructions do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings wherein like reference numerals denote like elements and parts, in which:

DETAILED DESCRIPTION

The present invention includes a modular power distribution center that provides electrical connections of the device interface buss through mechanical connectors and also provides for integration of the electronic modules onto printed circuit board architectures.

Figure 1:
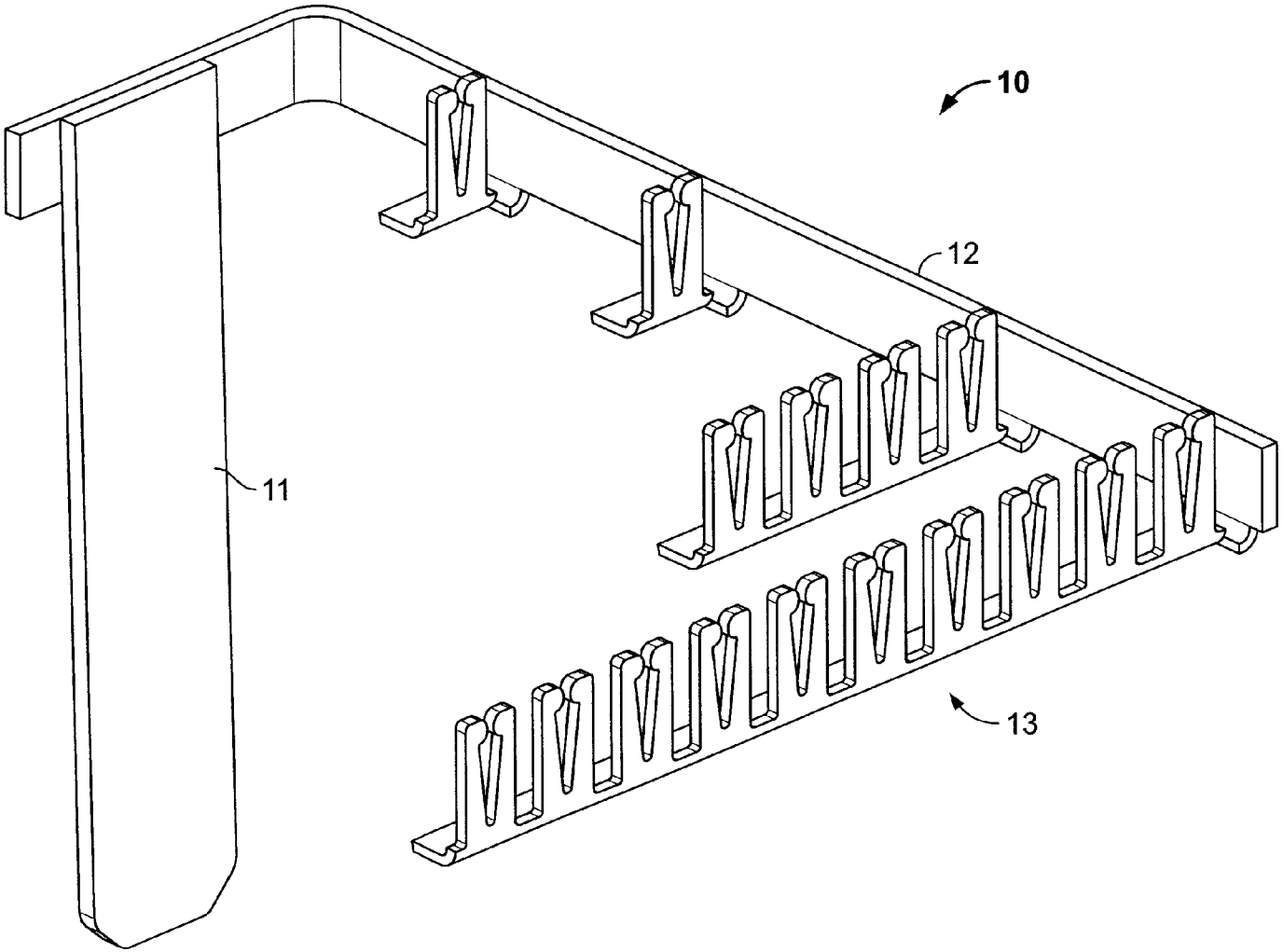
FIGS. 1 and 3D are perspective views of one embodiment of a modular power buss (also referred to as primary buss)

FIG. 1 depicts one embodiment of modular power buss 10 (also referred to as primary bus) which may include a positive battery terminal 11 (also referred to as B+ terminal), a primary strip 12, and at least one device interface buss 13. The primary buss 10 may be formed of conductive material such as copper. In one embodiment, the components of the primary buss 10 are formed from a sheet material by a stamping operation.

Figure 2A:
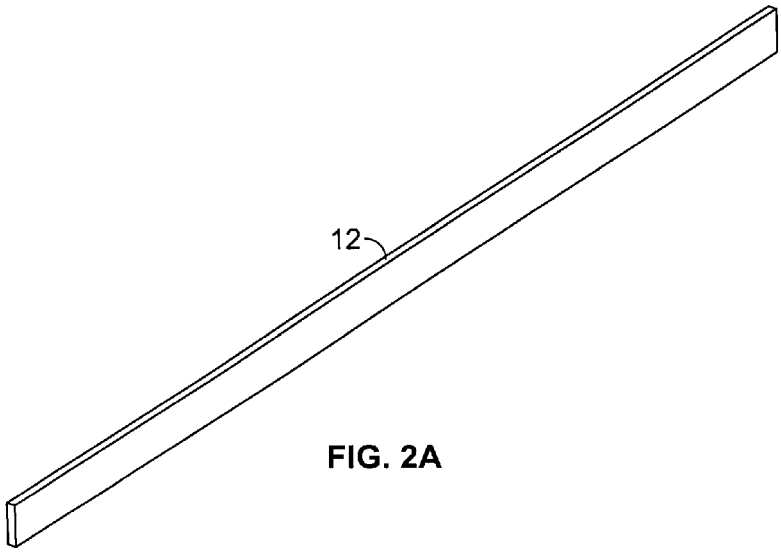
FIGS. 2A-2C show perspective views of one embodiment of the assembly of a primary strip to a positive battery terminal in providing one embodiment of a primary bus sub-assembly.
Figure 2B:
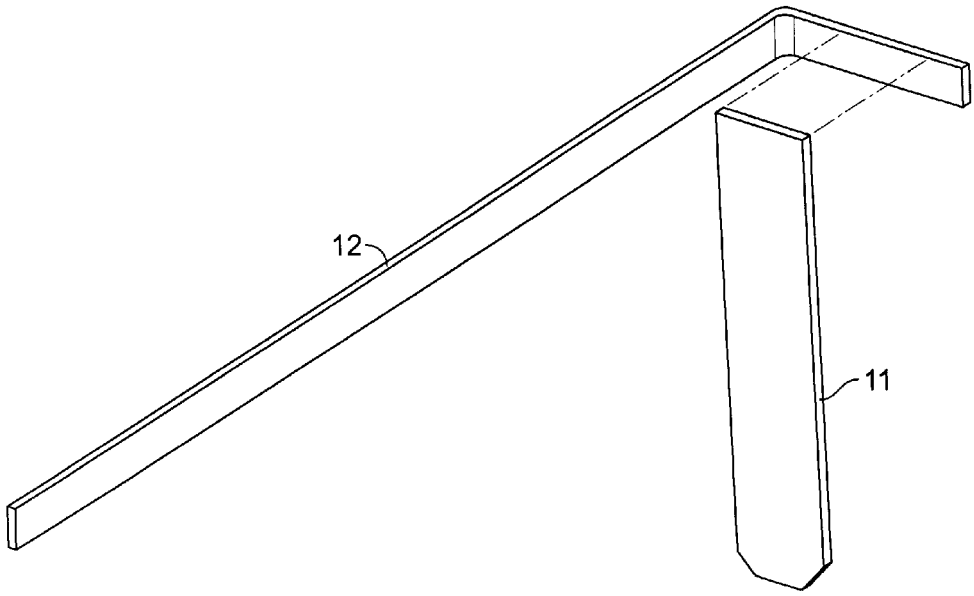
Figure 2C:
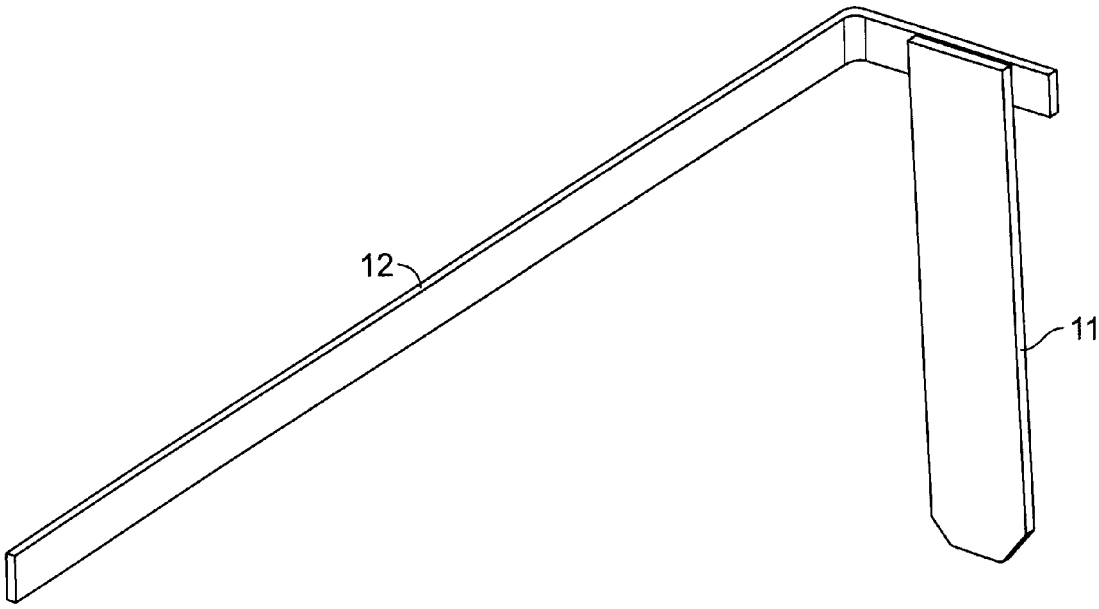

Referring to FIG. 2A, primary strip 12 may be cut to a preselected length along a first direction to provide for attachment of the device interface buss 13. The length and orientation of the primary bus strip 12 may be selected to contribute to the final electrical device layout to the modular power distribution center. FIG. 2B shows one embodiment of a positive battery terminal 11 being connected to a portion of the primary strip 12. The positive battery terminal 11 is connected to the positive terminal of the power supply and distributes power to the modular power distribution center which is a network of conductive paths having at least first and second In/Out (I/O) connection such as at least one or more printed circuit boards adapted to be coupled to an electrical device having at least two terminals. The connection between the primary strip 12 and the positive battery terminal 11 is by a mechanical connection. FIG. 2C shows a primary bus subassembly including the positive battery terminal 11 mechanically connected to the primary buss strip 12. In another embodiment, FIG. 5D, the power buss is not a separate part of the printed circuit board but is integral with and designed to be incorporated into the conductive routing of the Printed Circuit Board.

Figure 3A:
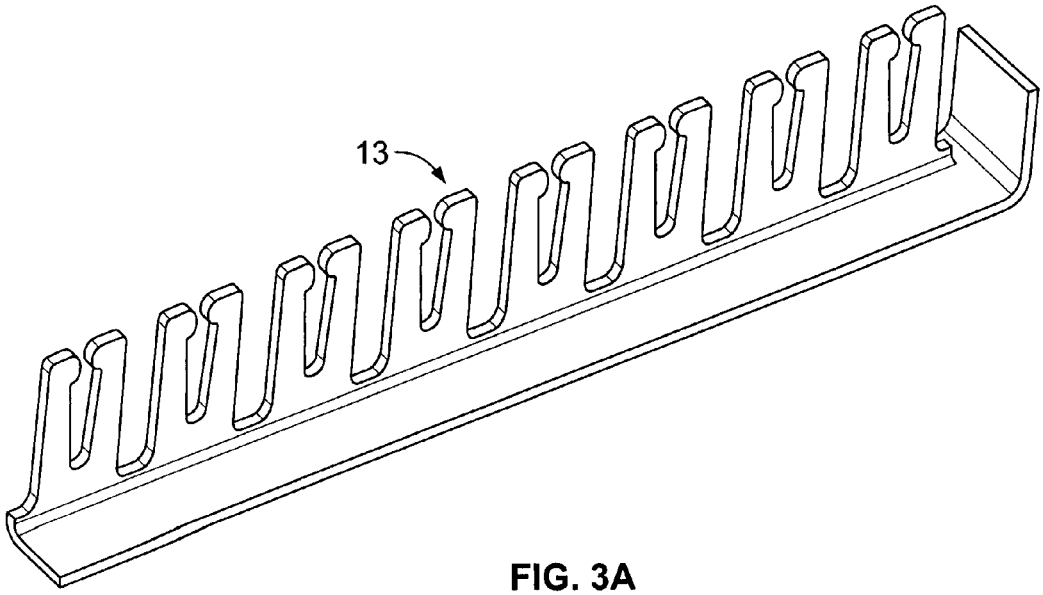
FIGS. 3A-3C show perspective views of the interface buss to the primary strip.
Figure 3B:
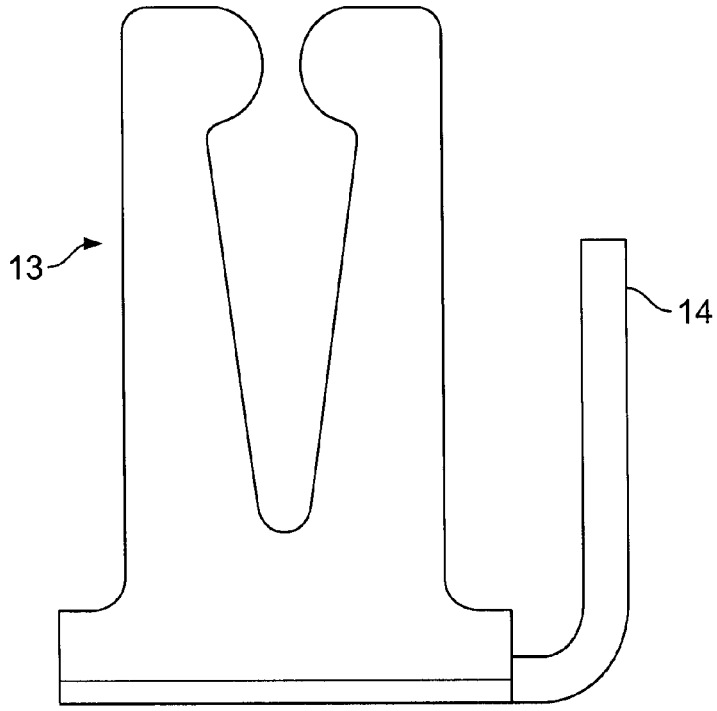

FIGS. 3A-3B show embodiments of device interface buss 13. The device interface buss 13 provides sites for electrical engagement to electrical devices. For the purposes of this disclose the term electrical devices includes, but is not limited to: fuses, relays, resistors, diodes, and switches. FIG. 3A depicts one embodiment of a device interface bus 13 configured to provide connections to 280 series devices. In one embodiment, the device interface buss 13 may be configured for engagement to 280 series devices that have a length sufficient to provide for the number of devices which are to be received. The 280 series devices are devices which are manufactured by various companies, one of which is Omron Automotive Electronics, Inc. They have male terminals of a conductive material which are approximately 2.8 mm in width, 0.8 mm thickness and a length which is suitable for making an electrical connection. The standard array, or pattern of the terminals on the devices generally conform to 7.8 mm by 8.1 mm. where the long axis of the terminal is aligned in the 7.8 mm dimension and the short axis in the 8.1 mm dimension. In one embodiment, ten positions for device engagement are provided, it being understood, however, that the number of positions can be increased or decreased to satisfy a predetermined device layout by using variable strip width tooling. The device interface buss 13 is disposed along a direction substantially perpendicular to the direction of the primary buss strip 12.

Figure 3C:
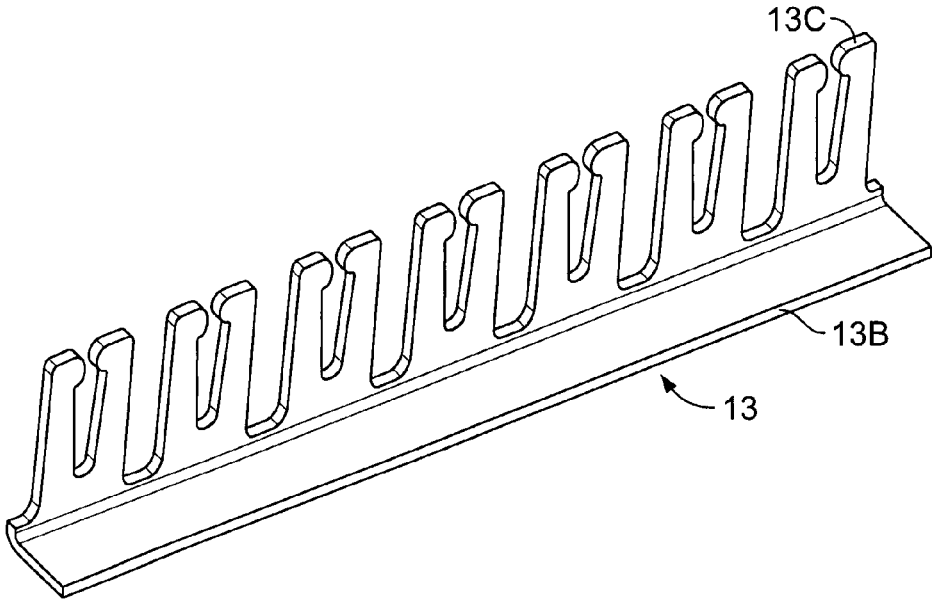

The device interface buss 13 is configured for mechanical connection to the primary strip 12. FIG. 3B shows a device interface buss 13 having a flag end 14, where the flag end 14 is overlapped against the primary strip 12 to provide a mechanical connection between the device interface buss 13 and the primary strip 12. Although, device interface buss 13 having flag end portions 14 is shown, a flagless interface buss can be used and is within the scope of the present invention. Referring to FIG. 3C, flagless interface buss 13B may have from two to fifteen or more positions 13C for electrical device connections.

Figure 3D:
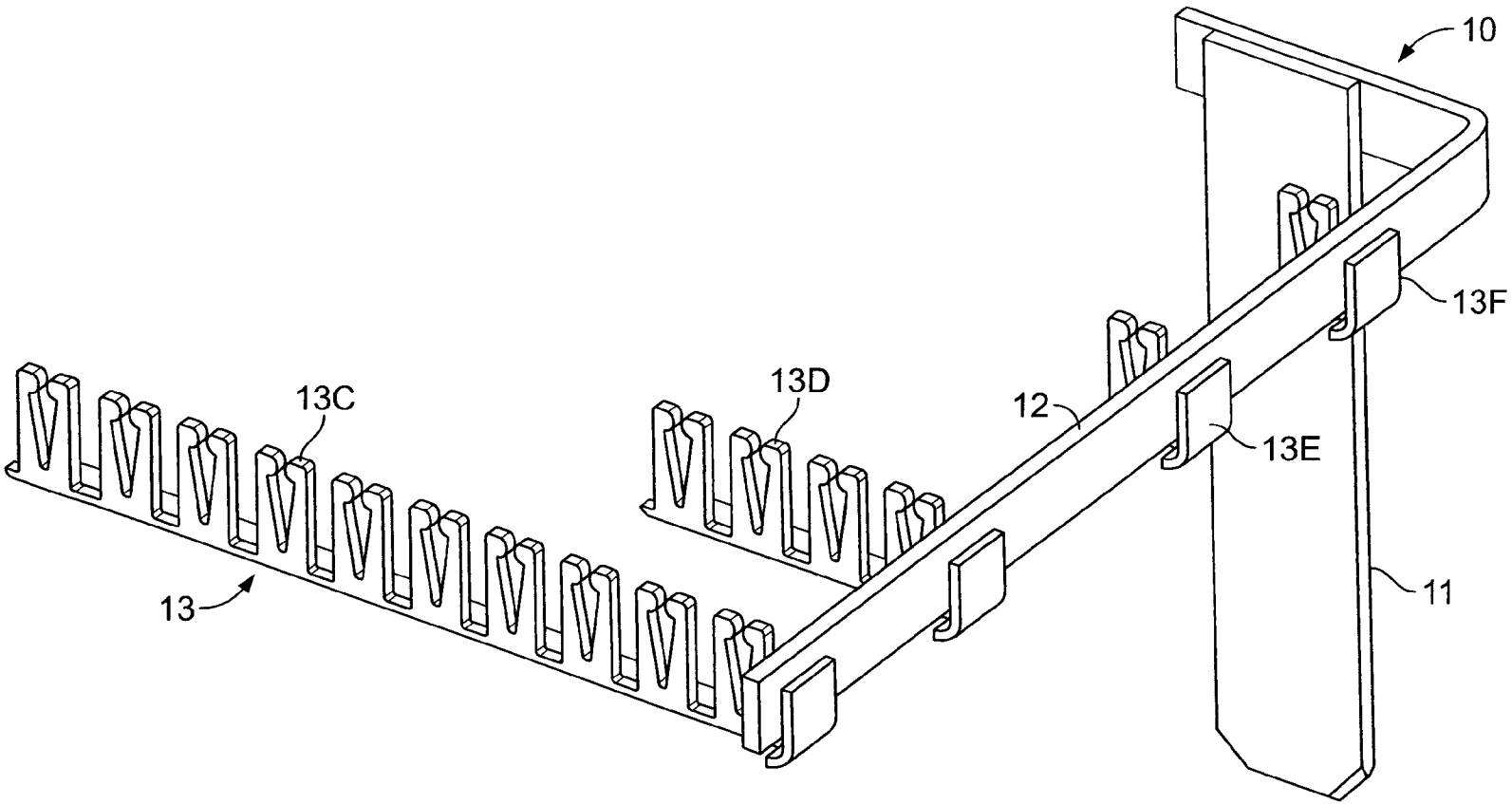

FIG. 3D shows a primary buss 10 assemblage including battery positive terminal 11, primary strip 12, and device interface buss 13. The number, geometry and length of the interface buss 13, in combination with the length and geometry of the primary buss strip 12, provides the layout for electrical device connections to the power distribution center. The primary buss assembly 10 can include four device interface busses 13C, 13D, 13E, 13F connected to the primary buss strip 12, where the device interface buss includes, for example, ten (more or less) positions for electrical device connections 13C, four (more or less) positions for electrical device connections 13D and one (more or less) position for electrical device connections. It is noted that the primary buss assembly 10 shown in FIG. 3D is provided for illustrative purposes only as other configurations have been contemplated and are within the scope of the present invention.

The mechanical connection of the device interface buss 13 and the positive battery terminal 11 to the primary strip 12 can be provided by a deformation joint, such as an integral rivet formed between the primary strip 12 and the device interface buss 13 or the positive battery terminal 11. The connection of the device interface buss 13 and the positive battery terminal 11 to the primary strip 12 can be accomplished by a system know in the art as TOG-L-LOC (a trademark of BTM Corp. of Marysville, Mich.)

Figure 4A:
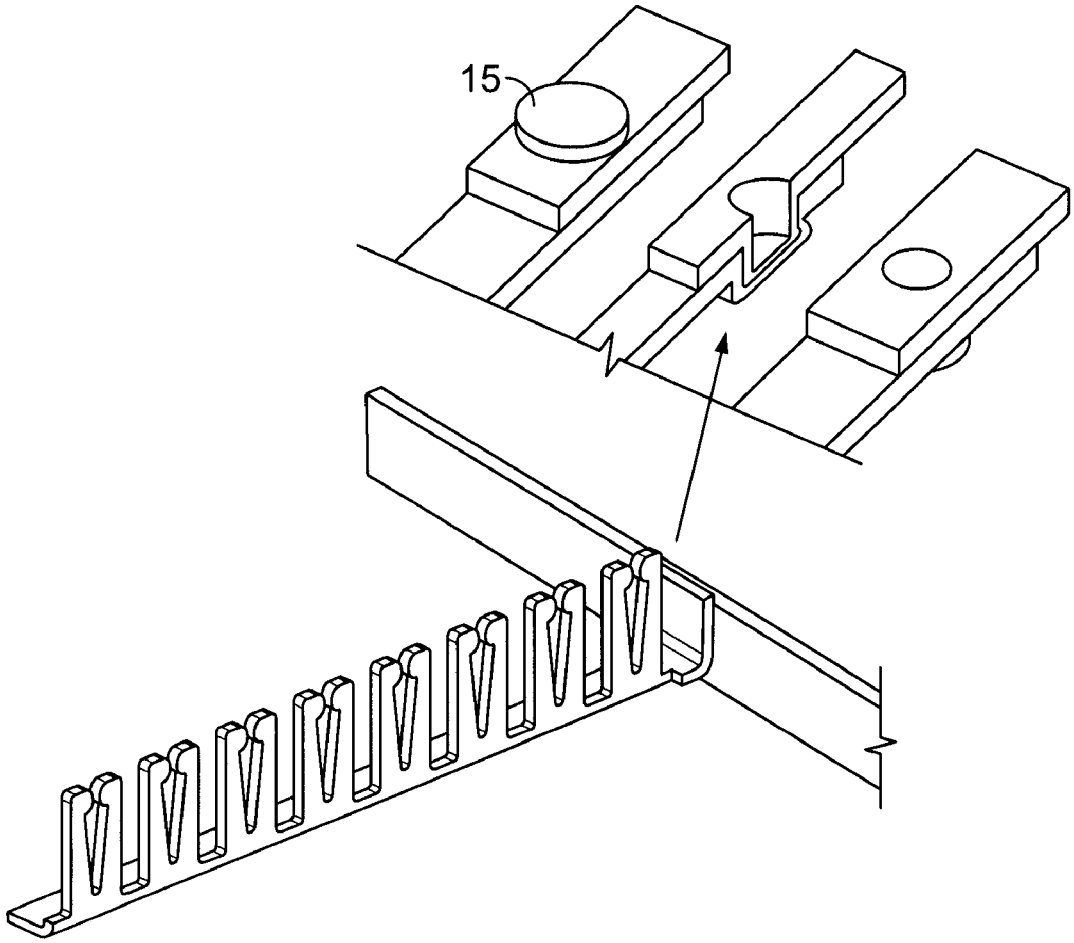
FIG. 4A is a perspective view of an integral rivet.
Figure 4B:
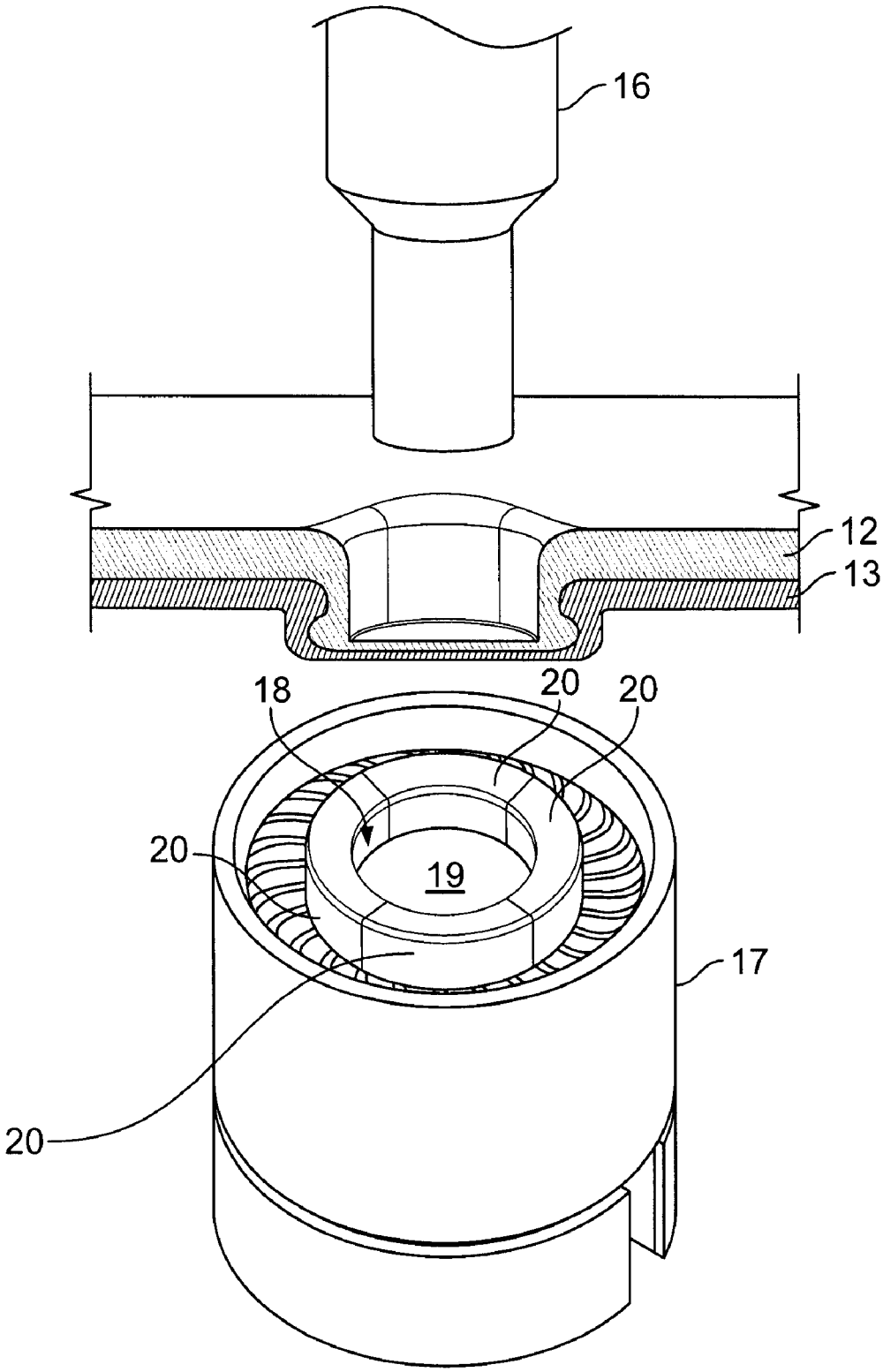
FIG. 4B is a perspective view of a tool and die tool set for forming an integral rivet between the primary strip and the device interface buss or positive battery terminal.

One example of an integral rivet 15 is shown in FIG. 4A. The integral rivet 15 is provided by a punch 16 and die tool 17, as shown in FIG. 4B. The punch 16 and die 17 work surfaces are preferably configured to form a cup-shaped rivet between the metal surfaces of the primary strip 12 and the device interface buss 13 or the positive battery terminal 11. A more detailed description of a punch and die tool set that is suitable for providing the integral rivet 15 can be found in U.S. Pat. No. 4,757,608, titled "Apparatus for joining sheet material" and U.S. Pat. No. 4,459,735, titled "Joining sheet metal".

Figure 4C:
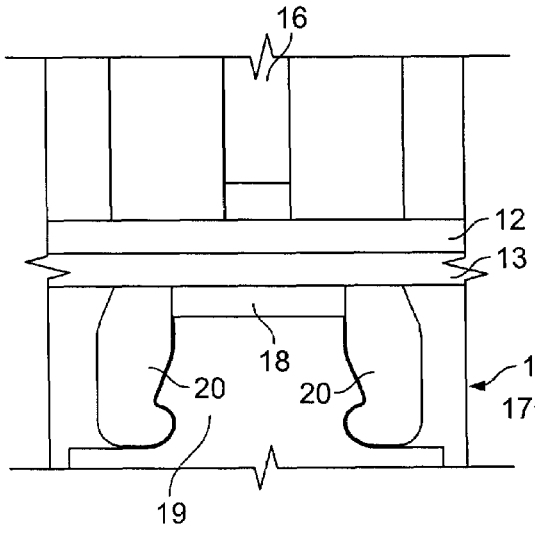
FIGS. 4C-4E show side cross sectional views of the mechanical connection of the device interface buss and/or positive battery terminal to the primary strip in the power distribution center.
Figure 4D:
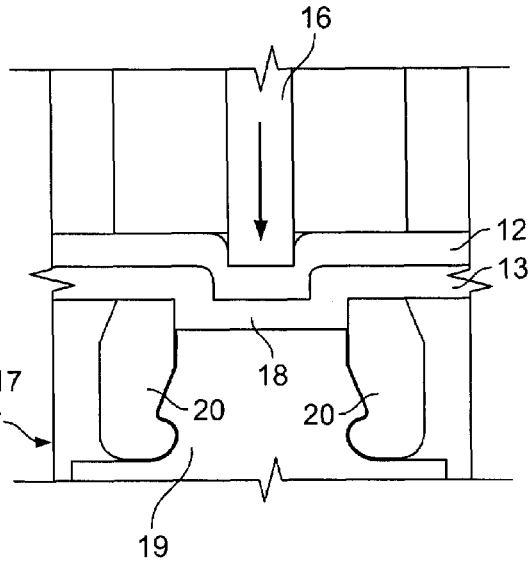
Figure 4E:
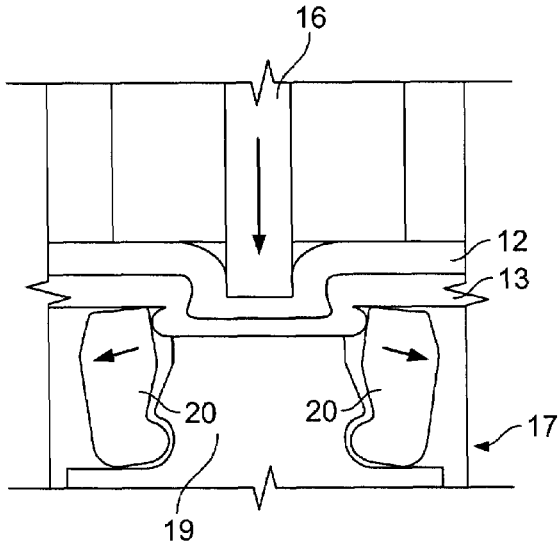

The formation of the integral rivet 15 between the primary strip 12 and the device interface buss 13 or positive battery terminal 11 by a punch and die tool, as shown in FIG. 4B, is described with reference to FIGS. 4C-4D. Referring to FIG. 4C, the primary strip 12 and the device interface buss 13 or positive battery terminal 11 are first positioned in overlapping fashion between the punch 16 and the die 17. The die 17 is positioning against one outside face of the overlapping metal including a cavity 18 defined by an anvil 19 forming the bottom surface of the cavity 18 (see FIG. 4B) and by opposed laterally expansible side wall members 20. Referring to FIG. 4B, in a next step the punch 16 draws the metals 11, 12, into the cavity 18 of the die 17. Referring to FIG. 4C, the punch 16 then squeezes the bottom of the drawn section laterally extruding the material to be joined into an enlarged shape that mechanically interlock the pieces. The die 17 is configured to provide laterally expandable side wall members 20 that are resiliently biased toward one another and pivot or slide laterally in response to lateral extrusion of the joining material. If desired, other known joining operations can be used such as welding, riveting, terminal type connections, etc.

Figure 4F:
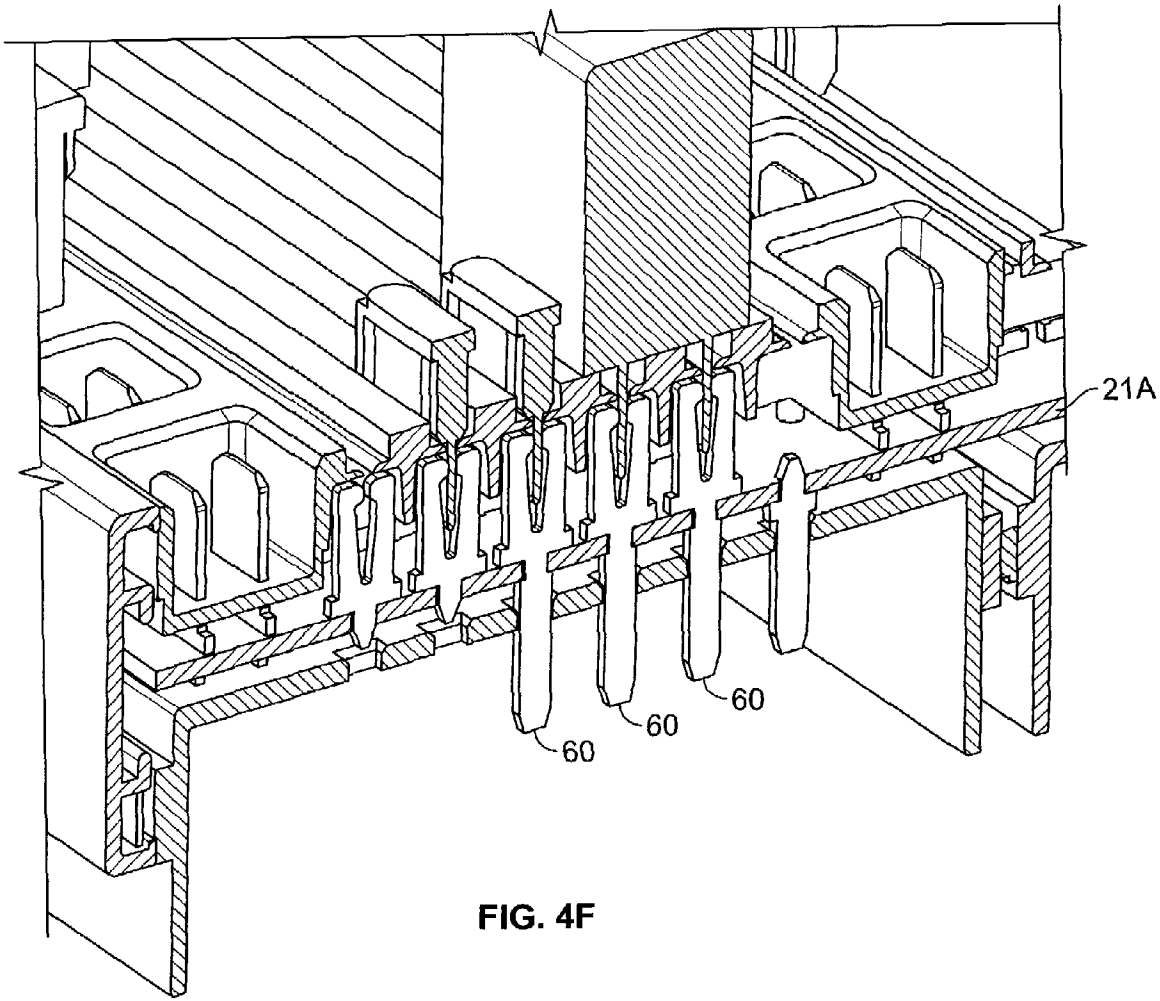
FIG. 4F shows a perspective sectional view of the modular power distribution center with pass through terminals 60 coupled to the printed circuit board.
Figure 4G:
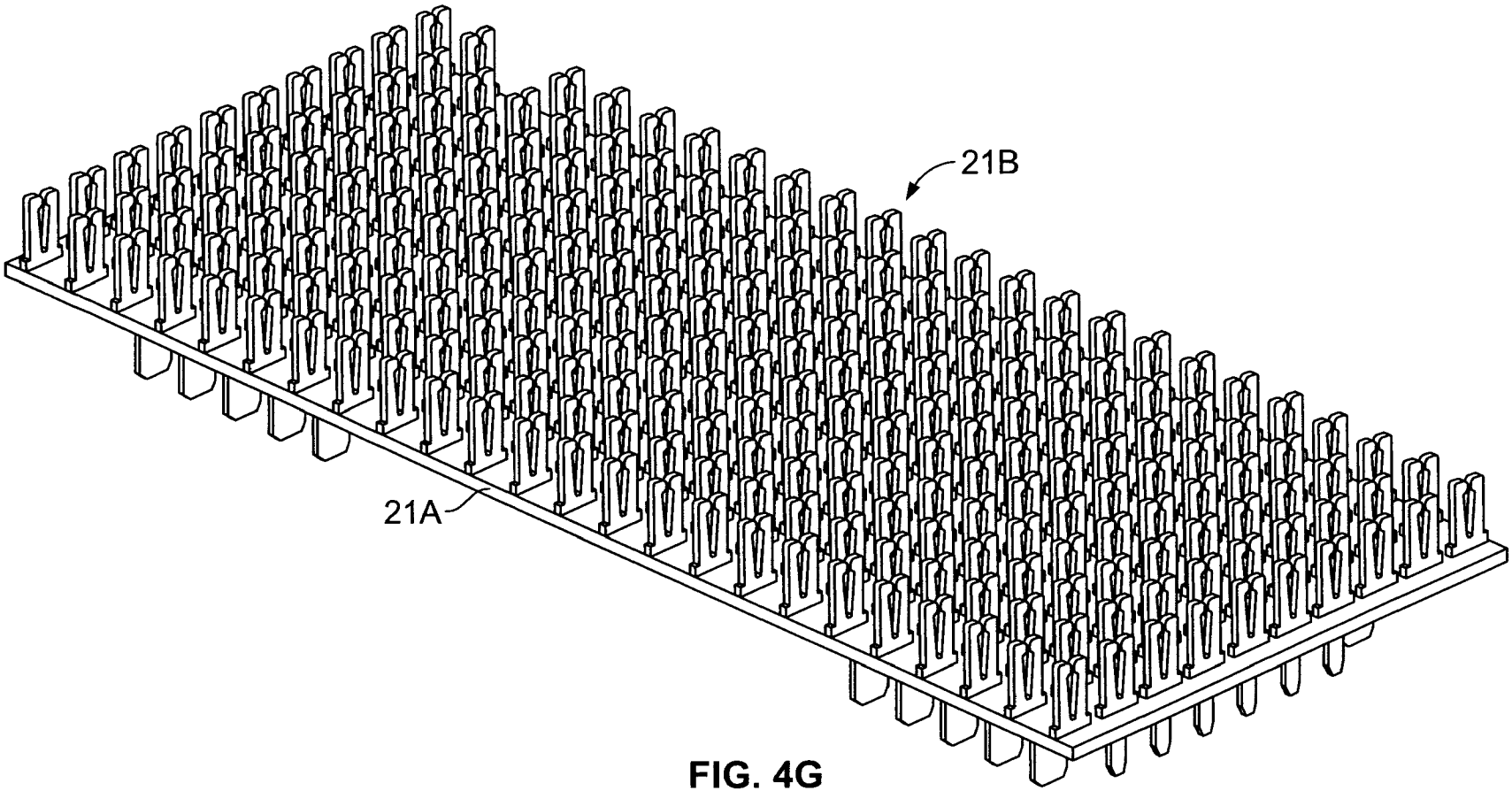
FIG. 4G is a perspective view of the top of the single printed circuit board of FIG. 4F.
Figure 4H:
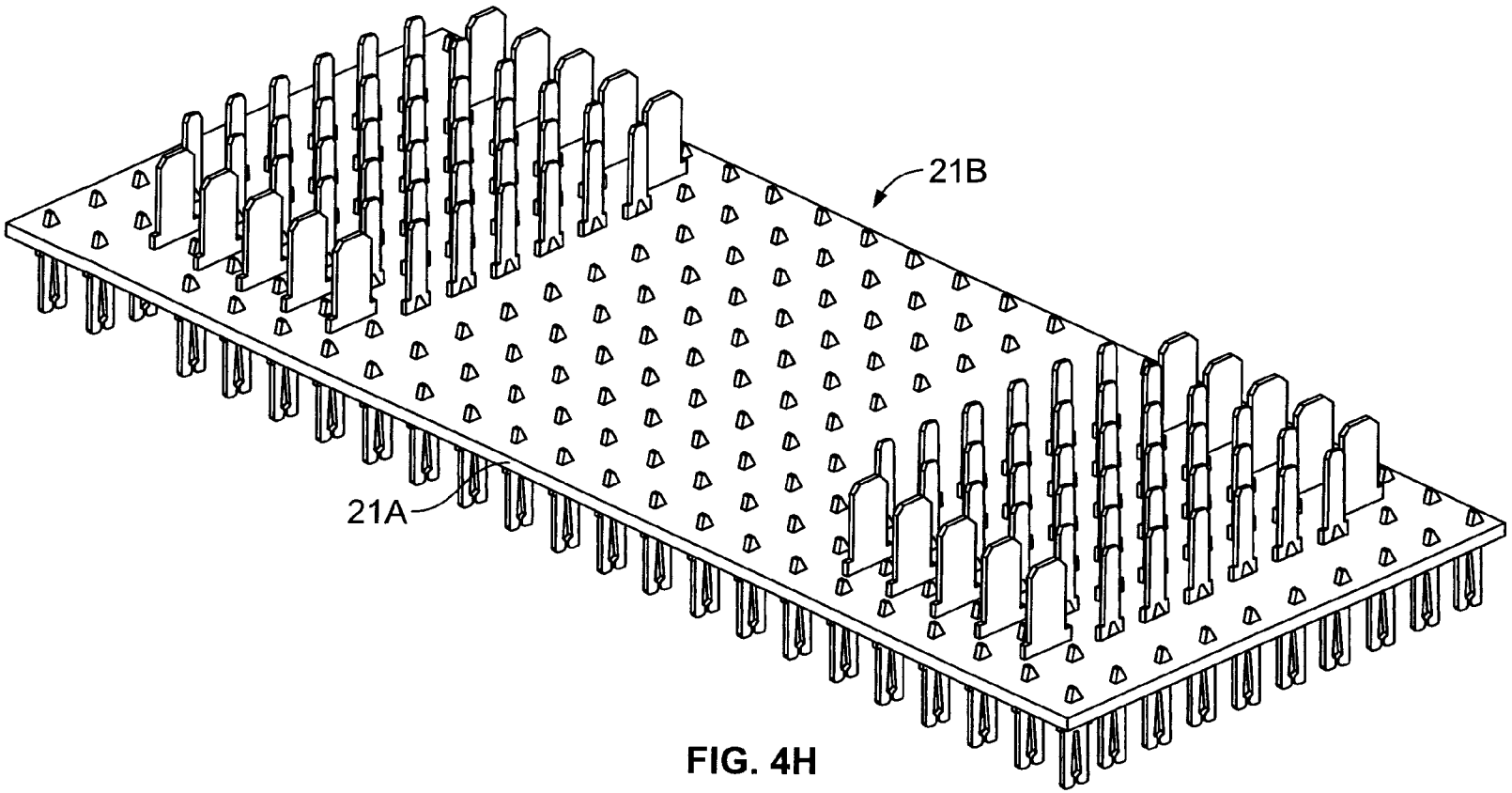
FIG. 4H is a perspective view of the bottom of the single printed circuit board of FIG. 4F.

In one embodiment the network of conductive paths comprises two printed circuit boards 23, 24 which are electrically connected together (see FIGS. 5A-5D). In another embodiment, (see FIGS. 4F, 4G, and 4H) in place of two printed circuit boards 23, 24, a single printed circuit board 21A having at least one primary buss integrated into the printed circuit board 21A is disclosed. With the embodiment of a single printed circuit board 21A, copper stampings are not required, mechanical fastening of buss bars are not required, pass through terminals can now be used, interconnect pins (52 in FIG. 5A) are not required, and a reduction of up to forty percent of the terminals needed is obtained. FIG. 4F shows a perspective sectional view of the modular power distribution center with pass through terminals 60 coupled to the printed circuit board 21A. FIG. 4G is a perspective view of the top of the printed circuit board assembly 21B; and FIG. 4H is a perspective view of the bottom of the printed circuit board 21B assembly.

FIGS. 5A-5D show two printed circuit boards 23, 24 for use with the modular power distribution center here disclosed. The printed circuit boards 23, 24 include conductive circuit paths which distribute power to electrical systems. For the purposes of this disclosure the term electrical systems includes, but is not limited to: head lights, signal lights, vehicle cabin lights, anti-lock brake components, radio's and stereo systems, power windows, power mirrors, power seats and any other electrical system typically used in motor vehicles.

Figure 5A:
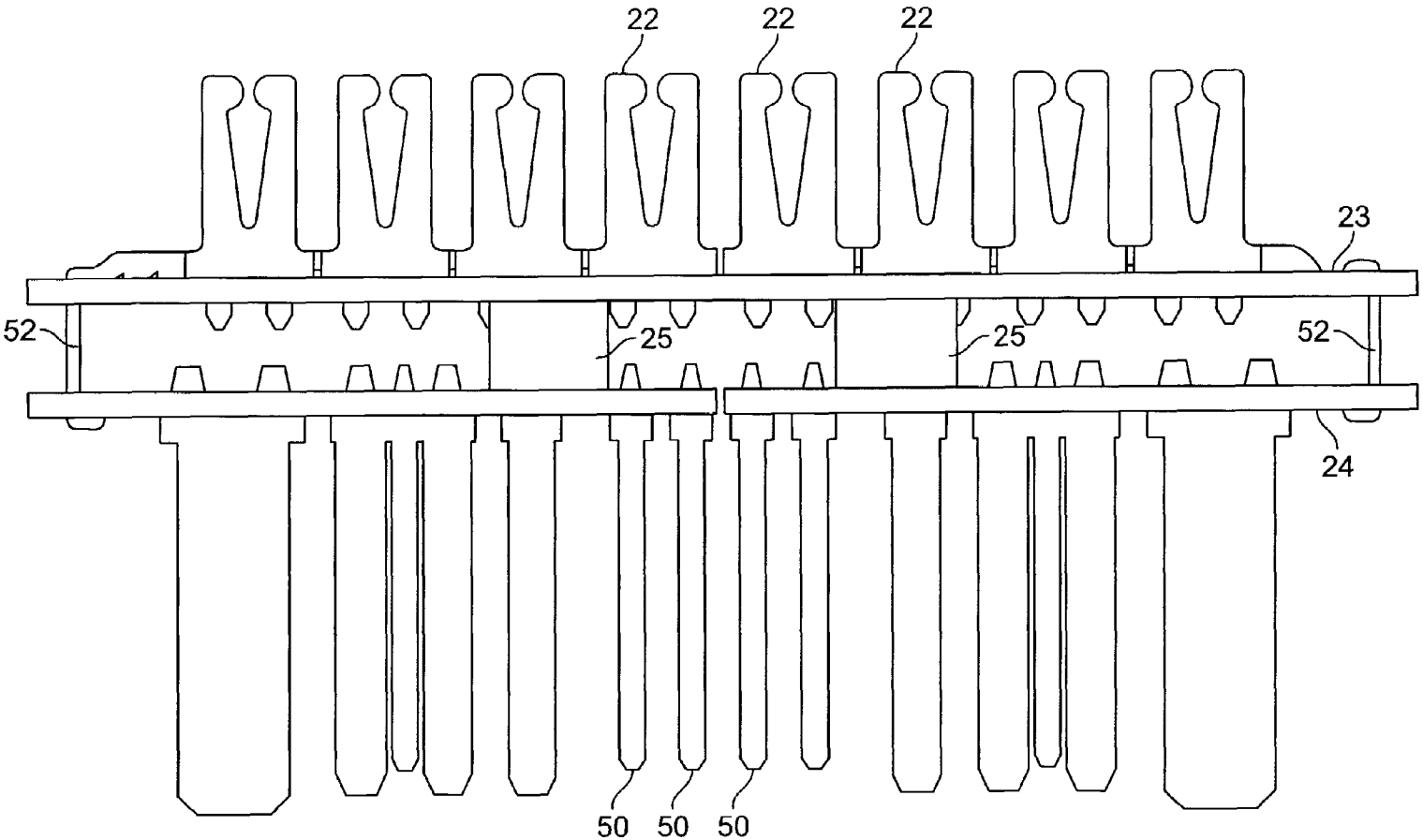
FIG. 5A shows a side cross sectional view of the printed circuit boards of the power distribution center.

Referring to FIG. 5A, the printed circuit board 24 includes male blade terminals 50 that provide input and output connections (also referred to as I/O connections) from the modular power distribution center to the electrical systems. The blade terminals can be formed of any conductive material such as, for example, copper or aluminum. The modular power buss is connected to the two printed circuit boards 24, 23 and may also be connected to at least one fork terminal 22. Fork terminals 22 are provided to interface with components which are designed into a circuit in the Power Distribution Center.

Figure 5B:
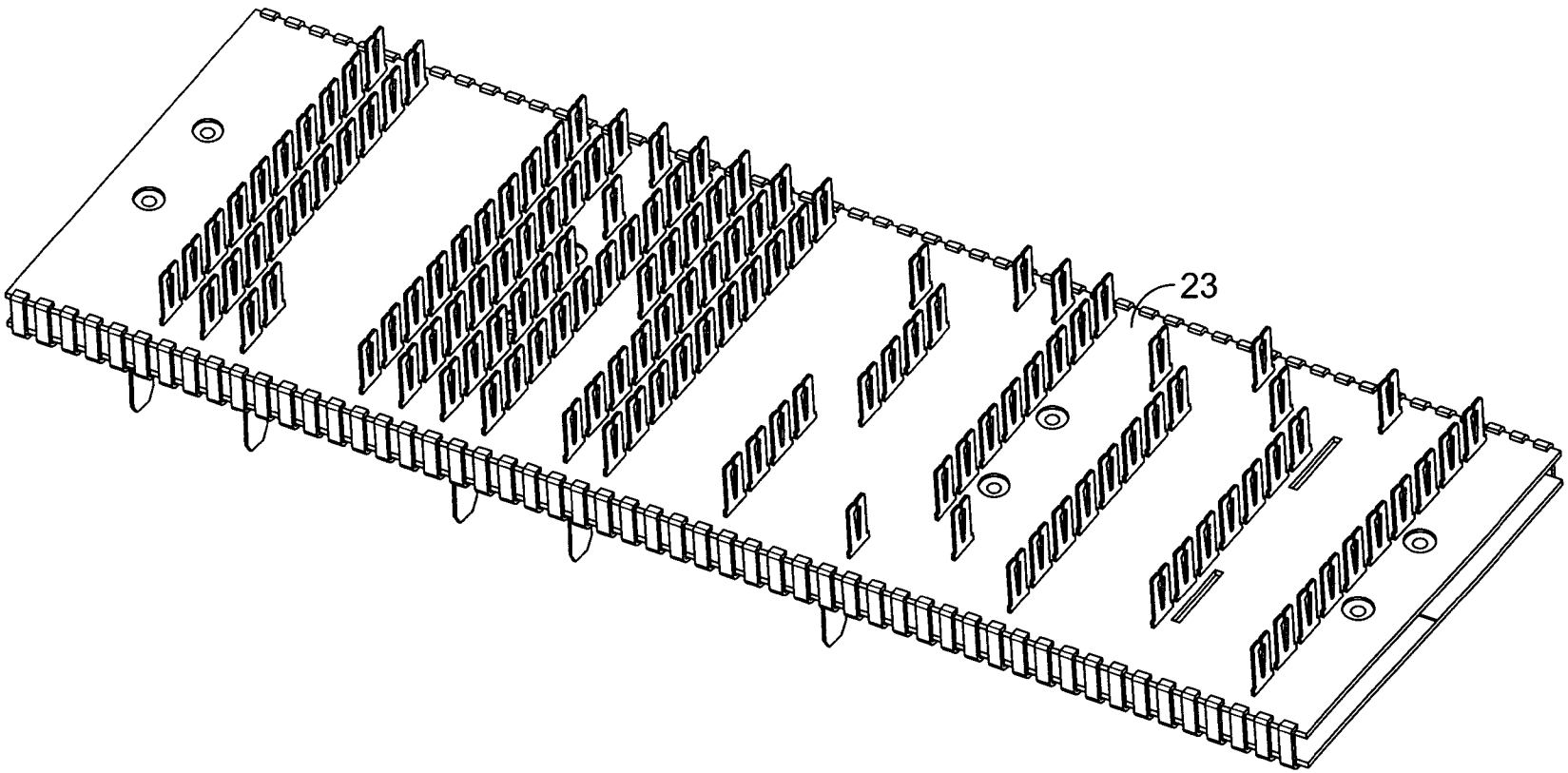
FIG. 5B shows an upper planar view of the printed circuit board of the power distribution center.
Figure 5C:
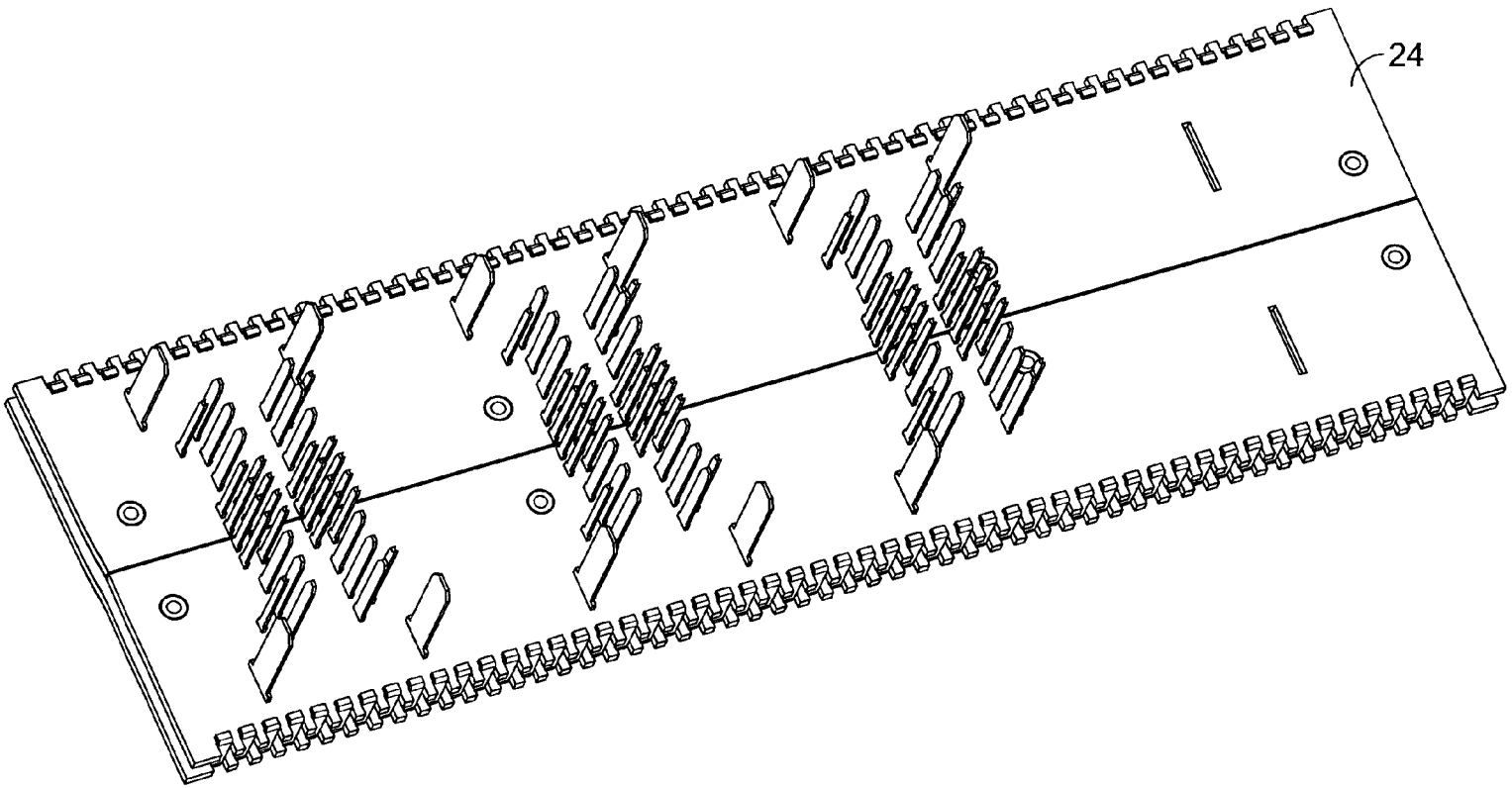
FIG. 5C shows a lower planar view of the printed circuit board of the power distribution center.
Figure 5D:
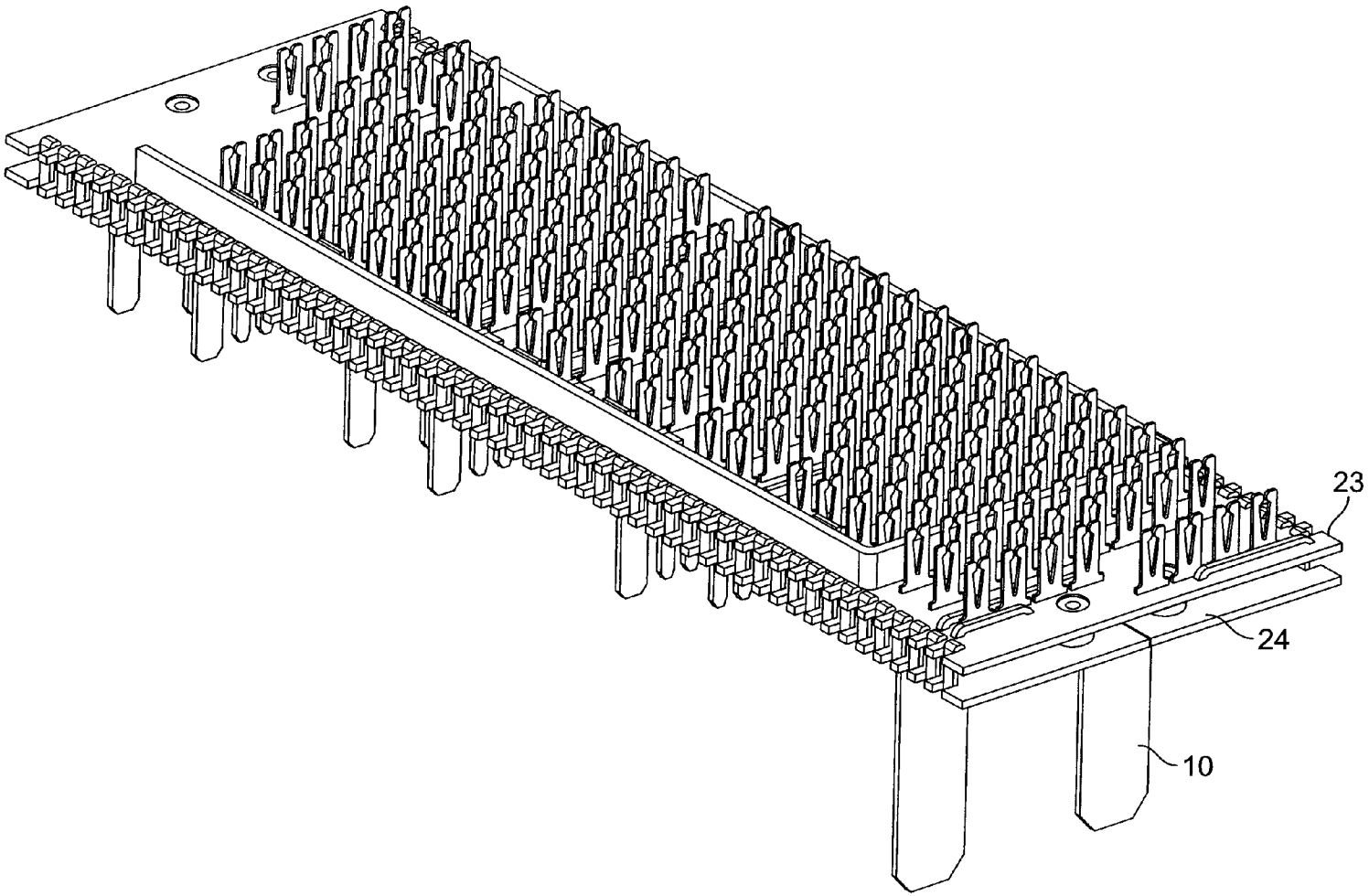
FIG. 5D is a perspective view of an assembly of the printed circuit boards and modular bussing.
Figure 5E:
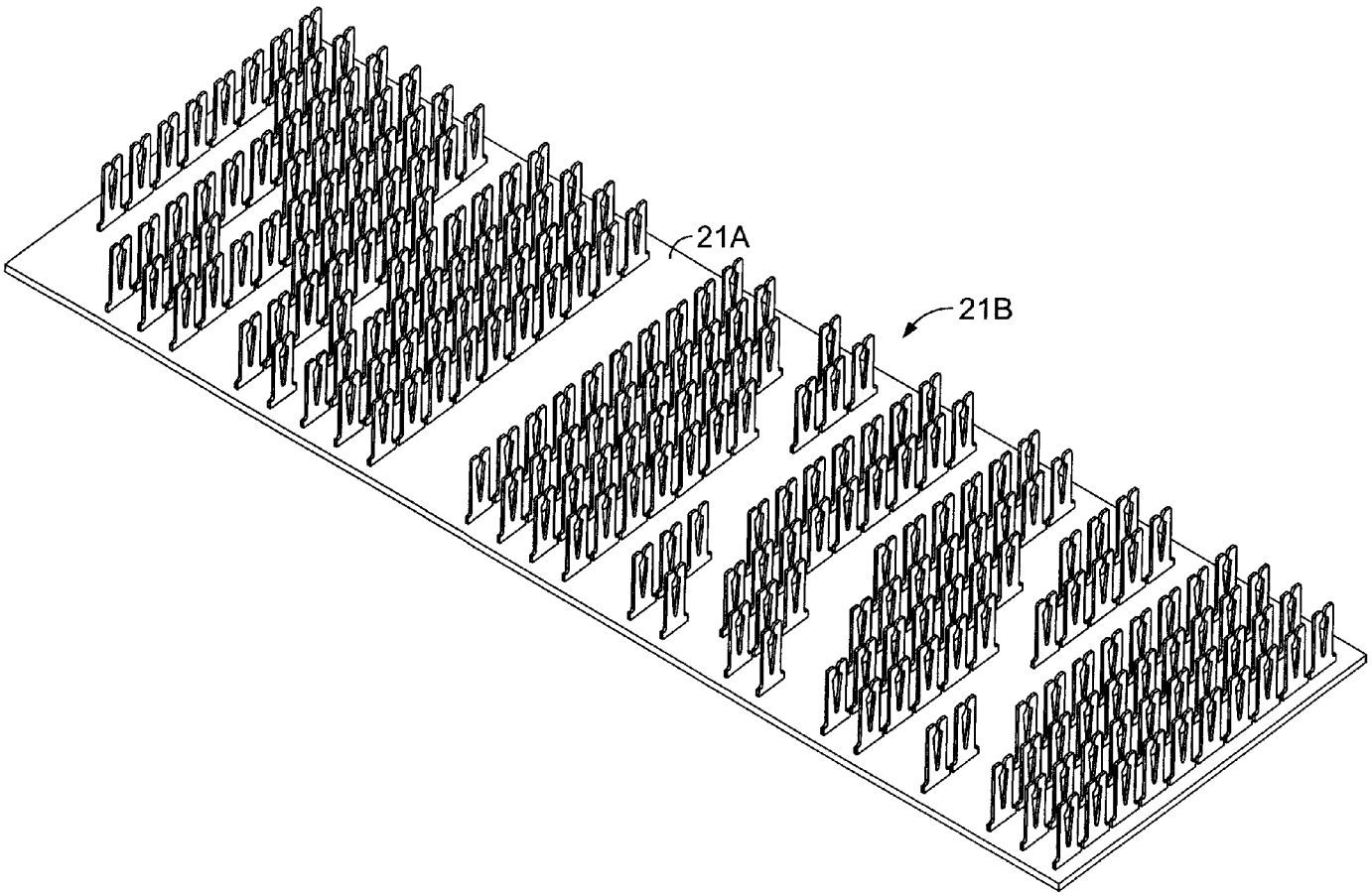
FIG. 5E is a perspective view of another embodiment of the power distribution center where only one printed circuit board is used and power is routed through the printed circuit board.

When two printed circuit boards 23, 24 are used, the primary buss distributes power to the upper printed circuit board 23 and electrical connections between the electrical devices and electrical systems, i.e. connections between fuses and I/O connections, are provided by a lower printed circuit board 24, where the lower printed circuit board 24 and the upper circuit board 23 are connected together electrically. The upper printed circuit board 23 and the lower printed circuit board 24 may be mechanically connected and separated by a spacer 25. FIG. 5B shows an upper planar view of the printed circuit board 23 of the power distribution center; FIG. 5C shows a lower planar view of the printed circuit board 24 of the power distribution center; and FIG. 5D is a perspective view of an assemblage of the upper and lower printed circuit boards 23, 24 and the modular power buss 10. FIG. 5E is a perspective view of the embodiment of the power distribution center where only one printed circuit board 21A is used and power is routed through the printed circuit board.

With either of the two embodiments disclosed, the first being the use of two printed circuit boards 23, 24 and the second being the use of a single printed circuit board 21A, bussing of power can be provided primarily through a series of stamped copper buss bars or power can be routed only through the printed circuit boards. There is no limitation for each embodiment as to how the power is routed.

However, the two embodiments have advantages which differ. For example, with the first embodiment, the buss bars and fork terminals are connected with a mechanical joint, such as Tog-L-Loc, using dedicated tooling; and, battery power buss bars are connected to the main buss bars with a resistance weld. With the second embodiment, mechanical fastening of buss bars is not required.

During assembly, with the first embodiment, mechanical joints (e.g. Tog-L-Loc), resistance welds, and soldering to the printed circuit board and interconnect pins 52 can be time consuming and difficult. With the second embodiment, the printed circuit board assembly 21B does not require interconnect pins and associated soldering, or any manufacturing processes associated with buss bars.

With the first embodiment, pass through terminals are not used. Typical routing includes input of battery power from a stud or connector, distributed through a buss bar, through the plug-in device (fuse or relay), through a fork terminal to the upper printed circuit board 23, upper printed circuit board trace to an interconnect pin, down through the interconnect pin 52, through a trace on the lower printed circuit board 24 to the output connector blade. With the second embodiment, pass through terminals are used. Typical routing includes input of battery power through a printed circuit board mounted stud, through a printed circuit board trace to a fork terminal, through the plug-in device (fuse of relay), and down through the pass through terminal to the output connector. In some applications the pass through terminal may be mechanically and/or electrically connected to the PCB in order to send current to another device or pin. An electrical connection to the PCB can be by, but not limited to, soldering, mechanical contact with another terminal or mechanical contact with the PCB conductive material. In another application where the pass through terminal may be used to assist in assembly or function as a terminal, the pass through terminal may be physically mounted to and only contact the non-conductive material of the PCB.

With the first embodiment which utilizes two printed circuit boards 23, 24, Tyco 40-way connectors or any other connectors which satisfy the requirements for the outputs in the entire Power Distribution Center design can be used. The second embodiment can use any connector which satisfies the requirements for the outputs in the entire Power Distribution Center design. However, because the second embodiment has only one printed circuit board 21A, pass through terminals can be used. To obtain the benefit obtained with the use of pass through terminals, the connector used should have the same pitch as the top plate.

With the first embodiment, interconnect pins 52 are required between the printed circuit boards 23, 24 and, therefore, assembly and soldering can be difficult. With the second embodiment interconnect pins 52 are not required and assembly and manufacture is simplified.

With the first embodiment, the printed circuit board assembly uses fork terminals, interconnect terminals, and connector blade terminals. With the second embodiment, the printed circuit board assembly uses fork terminals and connector blade terminals. When a pass through terminal is used, the corresponding fork terminal and connector blades terminals are not used.

If the height of the assemblage is important, the second embodiment should be considered because it has only one printed circuit board 21A and does not use interconnecting pins 52, the absence of which contributes to a reduction of height.

Figure 5F:
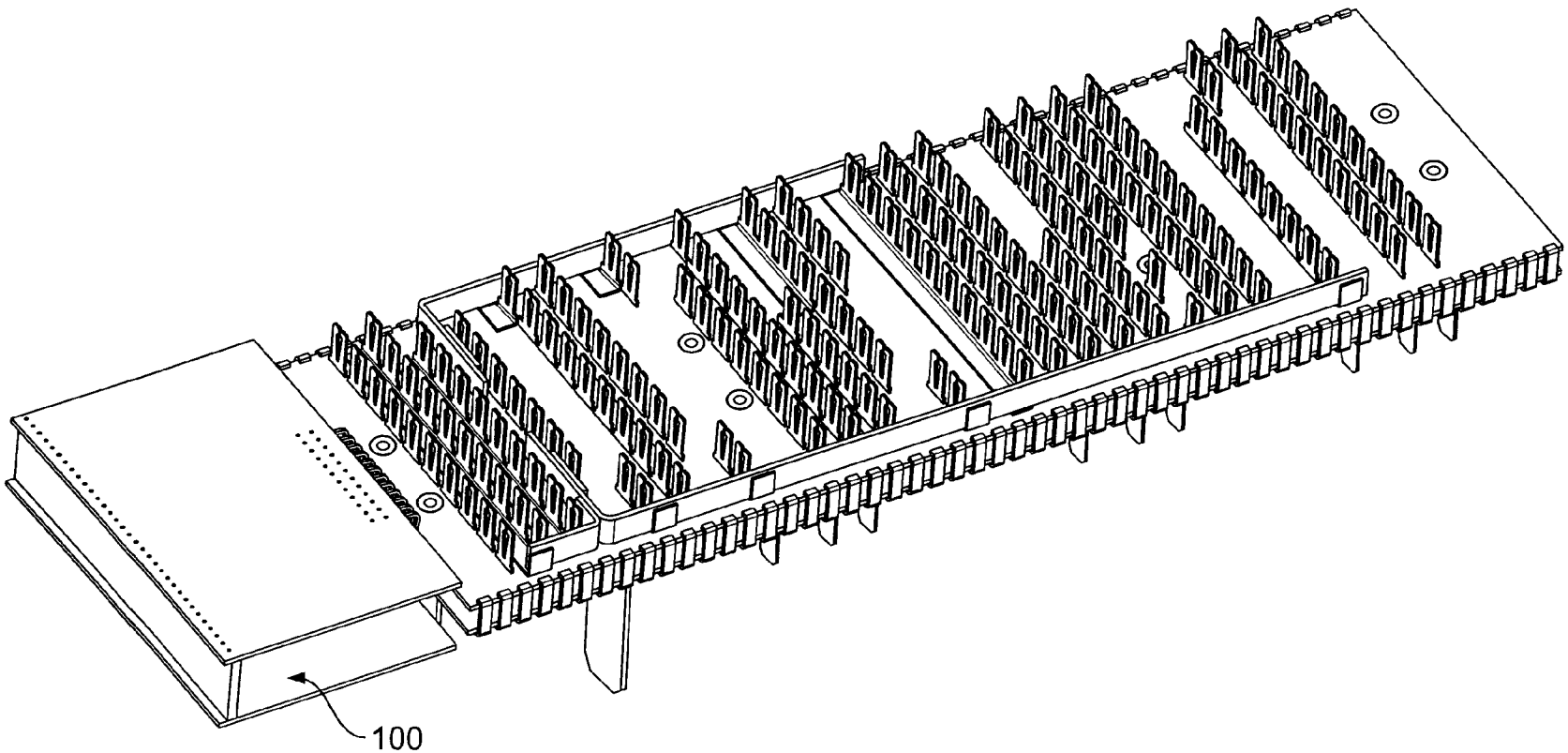
FIG. 5F is a perspective view of another embodiment of the power distribution center showing a supplemental printed circuit board coupled to the embodiments of FIGS. 5A and 5E.
Figure 5G:
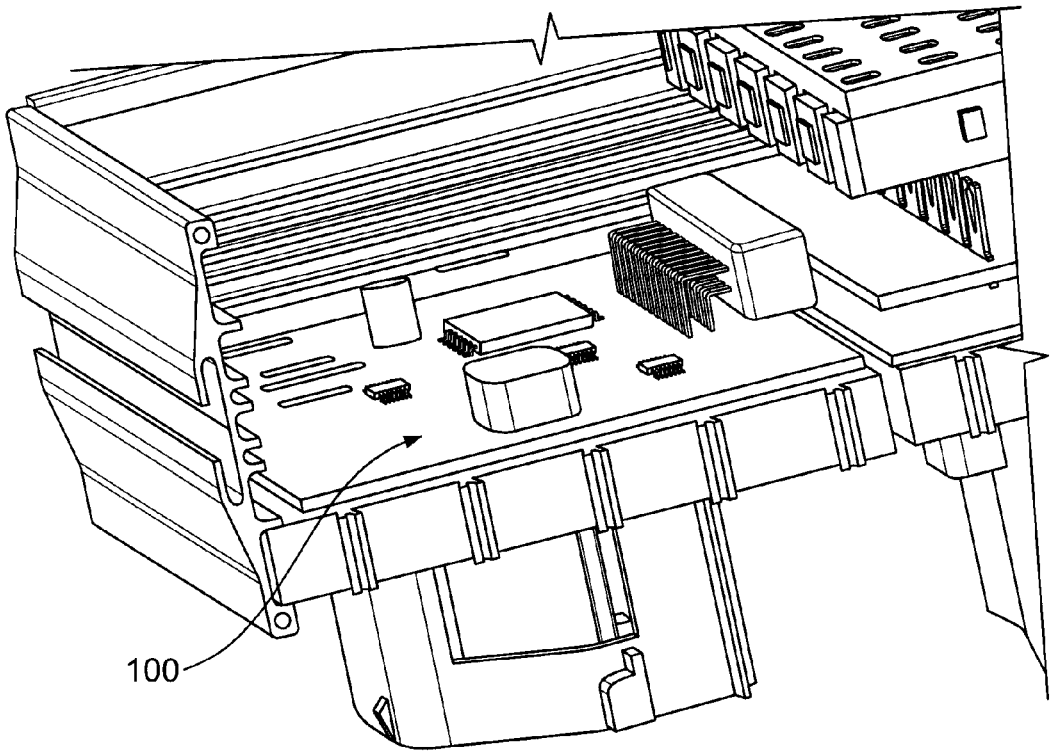
FIG. 5G is an enlarged perspective view of the supplemental printed circuit board.

In some applications the PCB can be connected to electronic devices which may or may not be surface mounted to the PCB. These devices can provide many functions that can include, but not limited to the switching of power, protection of devices, diagnostic capability and/or network transmissions over a bus to another module or switch where the network utilized can be, but is not limited to CAN, LIN, BSS, etc. Any of these components can be mounted on either PCB of the first embodiment and/or on either side of the PCB of the first embodiment, or they can be mounted on either side of both sides of the PCB of the second embodiment. In another embodiment, see FIGS. 5F and 5G, the components can be mounted on a supplemental circuit board assembly 100 which can be positioned adjacent to the PCB of the first or second embodiment.

Figure 5H:
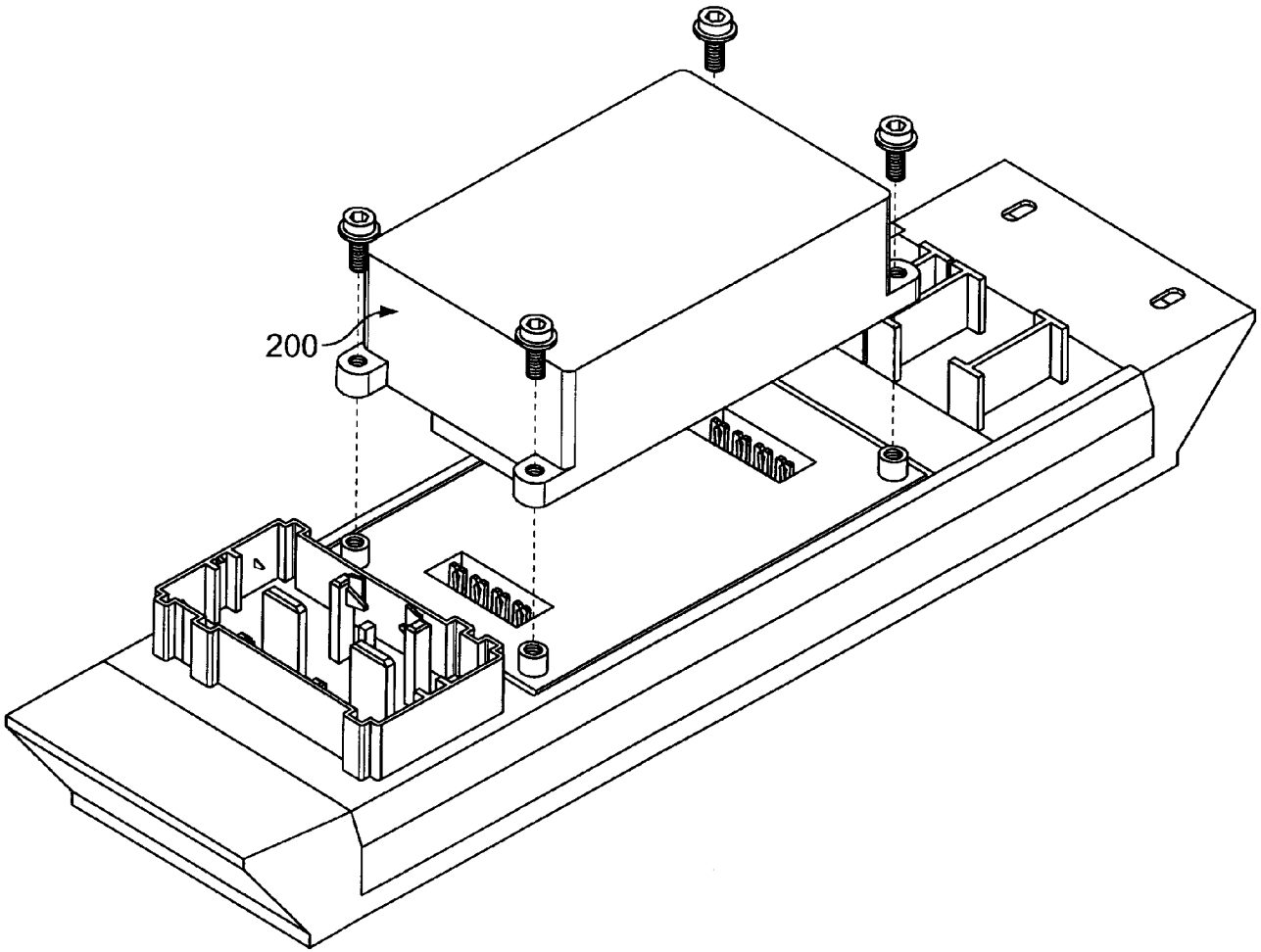
FIG. 5H is a expanded perspective view of the power distribution center with a plug in module.

In another embodiment, see FIG. 5H, the Power Distribution Center can have plug-in modules 200 which may be provided to add to the electronic capability of the entire assemblage without being soldered to the PCB of the first or second embodiment.

Figure 6A:
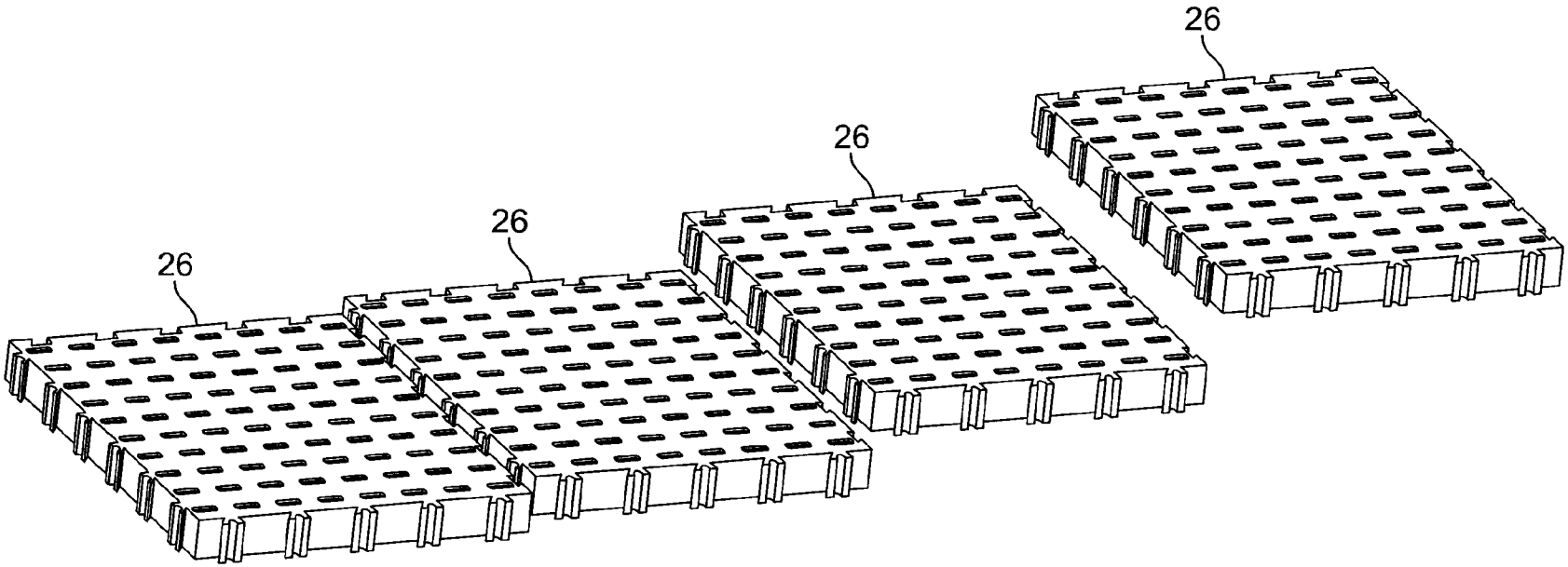
FIGS. 6A-6B are perspective views of a modular upper plate having a grid of receptacle portions corresponding to the electrical device connection of the at least one device interface buss of the modular power distribution center.
Figure 6B:
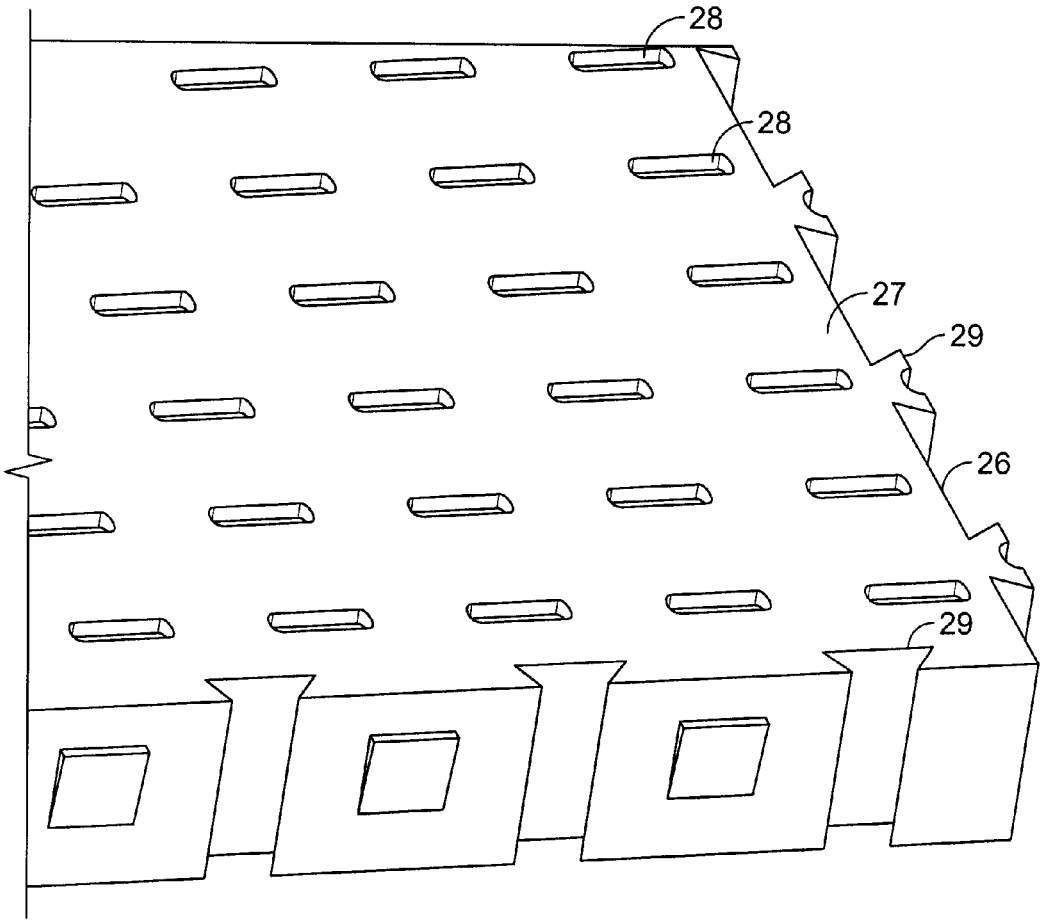

A modular housing assemblage encases the power buss 10 and the printed circuit boards 23, 24; or the single printed circuit board 21A shown in FIG. 5E, and the housing provides receptacle portions for engaging electrical devices and I/O connectors for electrical systems. Referring to FIGS. 6A-6B, the modular housing includes an insulating upper face 27 including at least one plate 26 having a grid of receptacle portions 28 defined through the face of the plate 26 that provide sites for electrical connection to the device interface buss 13.

The plates 26 have dimensions which allow them to be used as repeatable units, where the width and the length of the upper face 27 can be adjusted by adding or removing the plates 26 in reversible interlocking fashion to correspond to the required electrical devices and electrical system connector layout, as depicted in FIG. 6A. The plates are composed of an insulating material such as an insulating plastic. FIG. 6B shows the cavity portions 28 that are formed through the plates 26 of the upper face 27 and which are configured in a grid for receiving the contacts of electrical devices for connection through contacts located in the cavities to the underlying device interface bus. The electrical devices can be selected from the group consisting of fuses, relays, resistors, diodes, and switches. The grid of cavity portions 28 can be configured to receive various electrical devices which can include but is not limited to 280 devices. Thus the cavity portions 28 in the plates 26 can be configured to receive fuses, relays, etc., either separately or in combination with 280 series components where the cavities are spaced to allow a device to bridge a seam between two adjacent plates 26. Thus, with this structure, a component such as a fuse which has two blades, can be positioned to span a seam between two adjacent plates 26 where one blade of the fuse is located in a cavity portion 28 on one plate 26 and the other blade of the fuse is located in a cavity portion 28 on an adjacent plate 26.

Figure 8A:
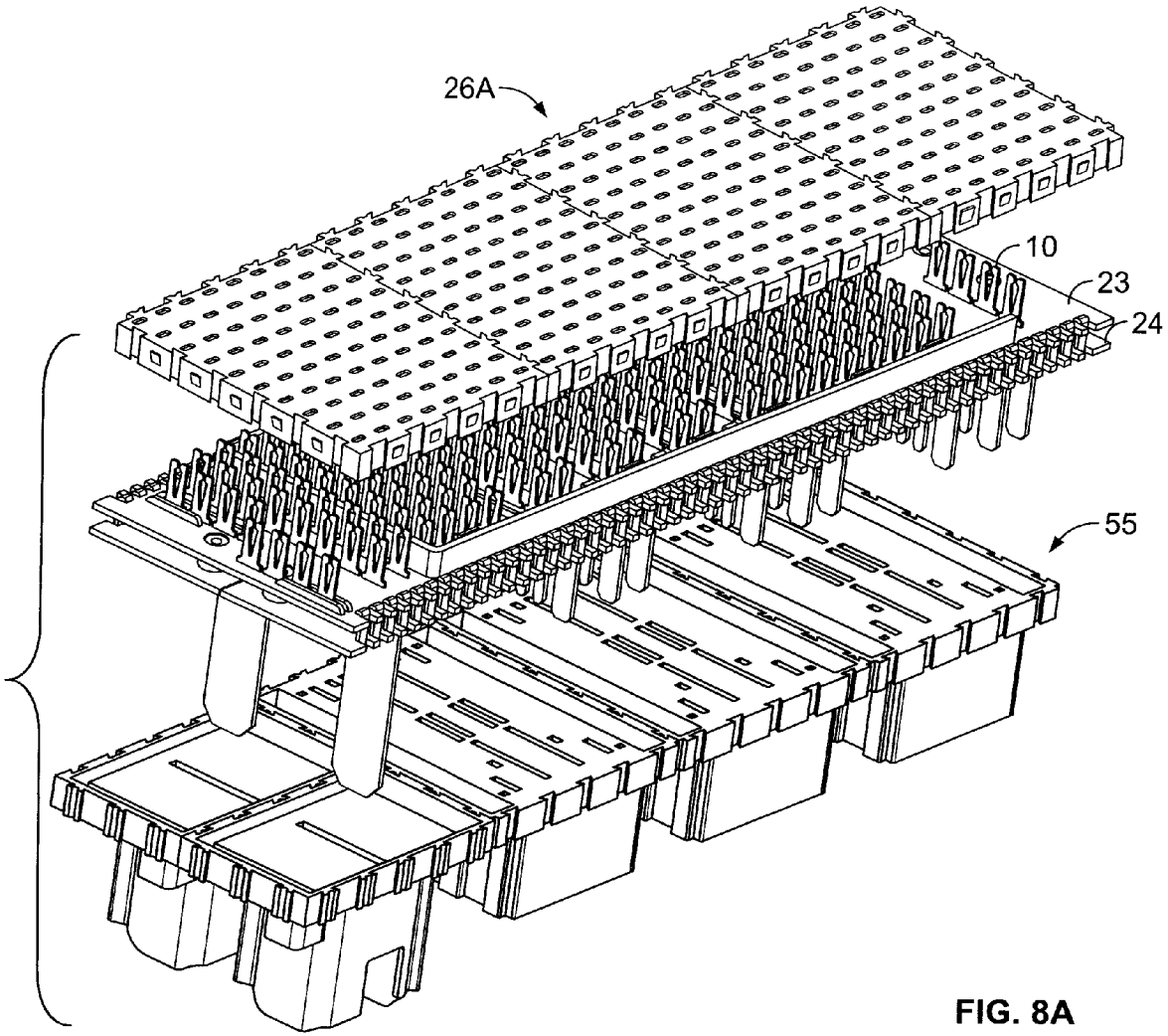
FIGS. 8A and 8B are perspective views of the modular upper plate, the modular lower plate, modular power buss and printed circuit boards of the modular power distribution center being assembled.
Figure 8B:
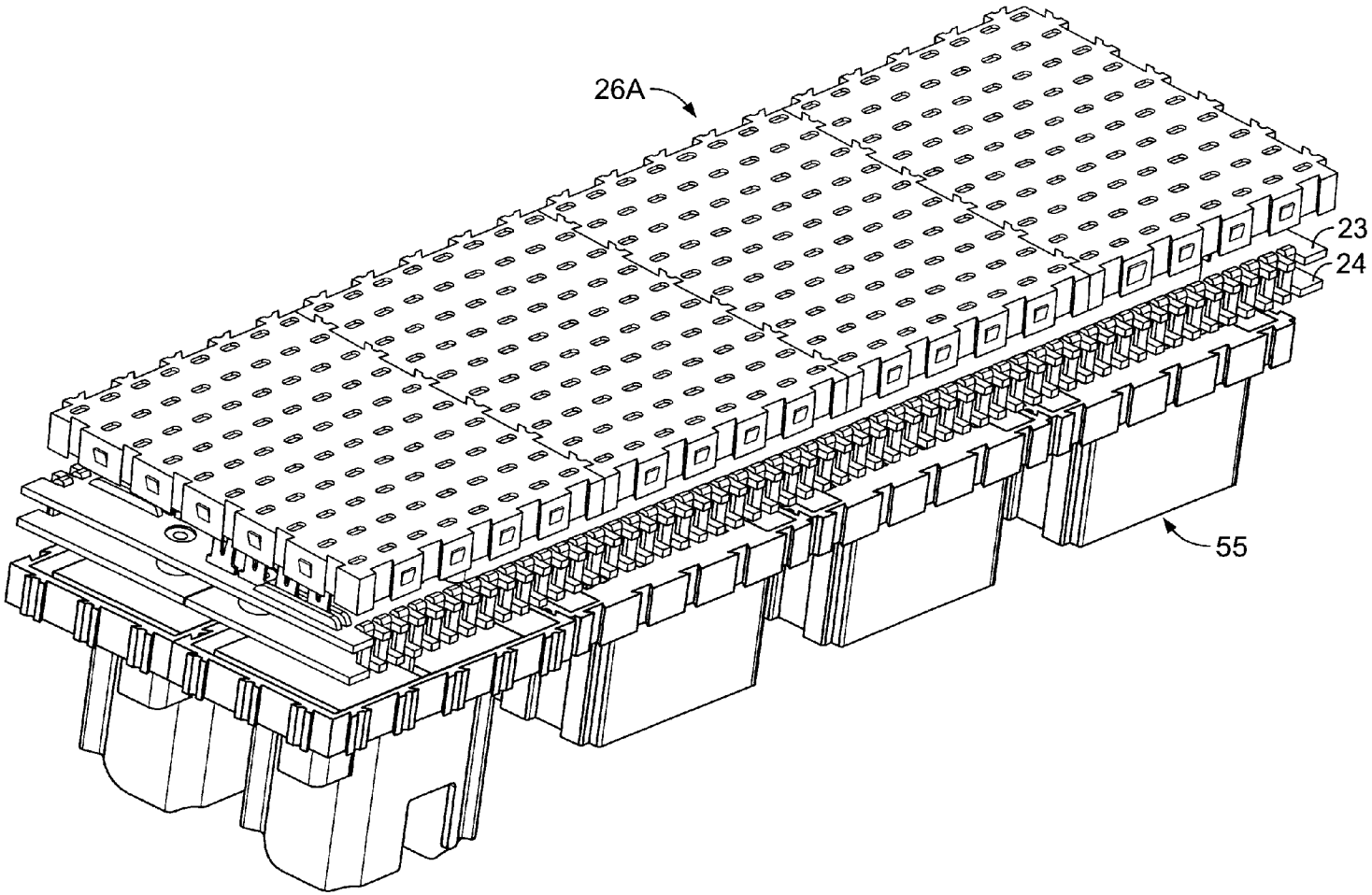

The edges of each plate 26 further include interlocking tabs 29, having a triangular geometry, for engaging interlocking tabs 29 on an adjacent plate 26 in reversible interlocking engagement. The interlocking tabs 29 may also be referred to as interlocking dovetails. It is noted that although the interlocking tabs 29 are shown as having a triangular geometry, other geometries are within the scope of the present invention. FIGS. 8A and 8B shows one embodiment of an upper face 27 that is an assemblage of four reversibly interlocking plates 26.

Figure 7A:
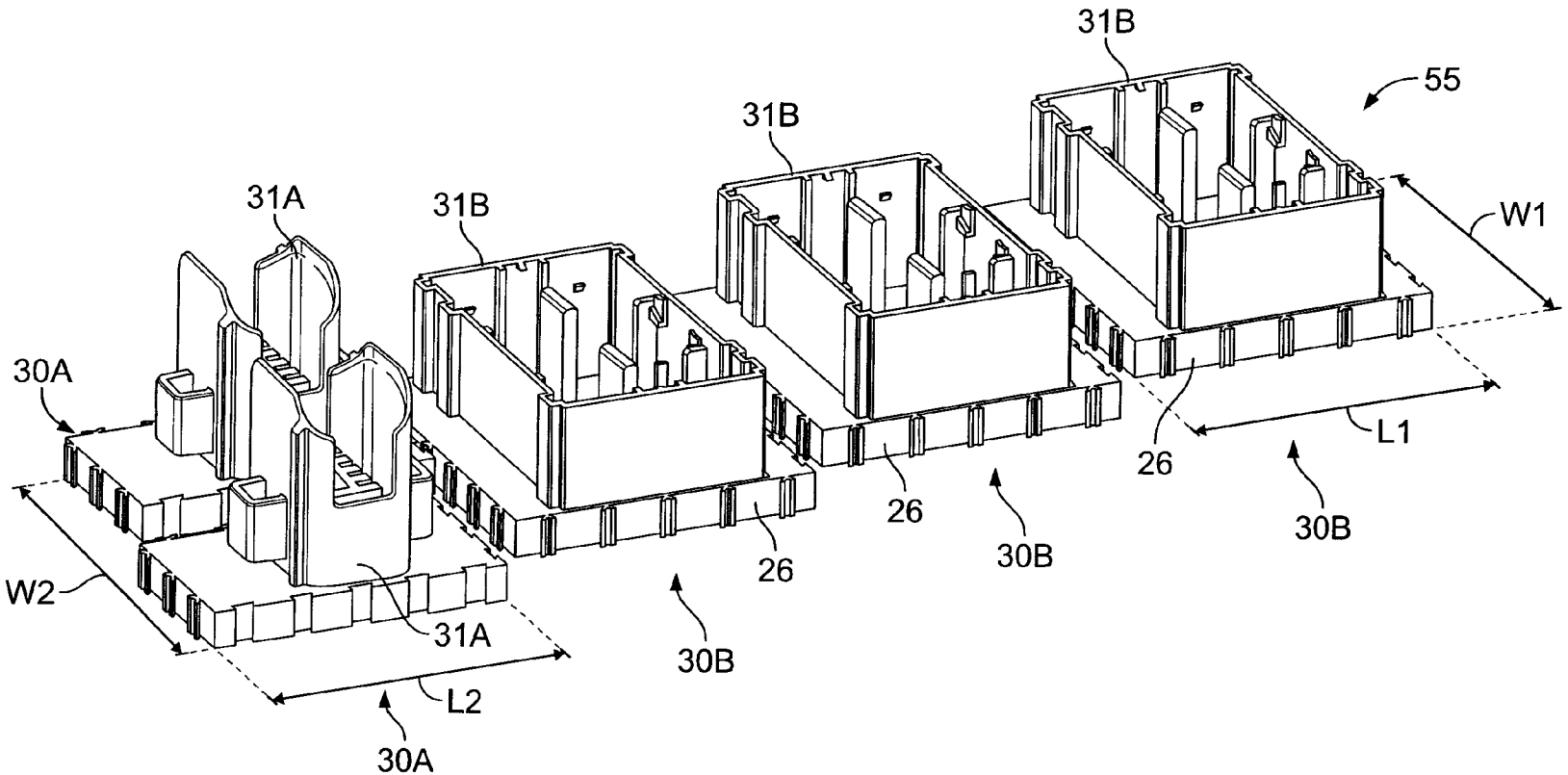
FIGS. 7A-7D are perspective views of a modular lower plate having at least one socket corresponding to the I/O connections of the printed circuit board of the modular power distribution center.
Figure 7B:
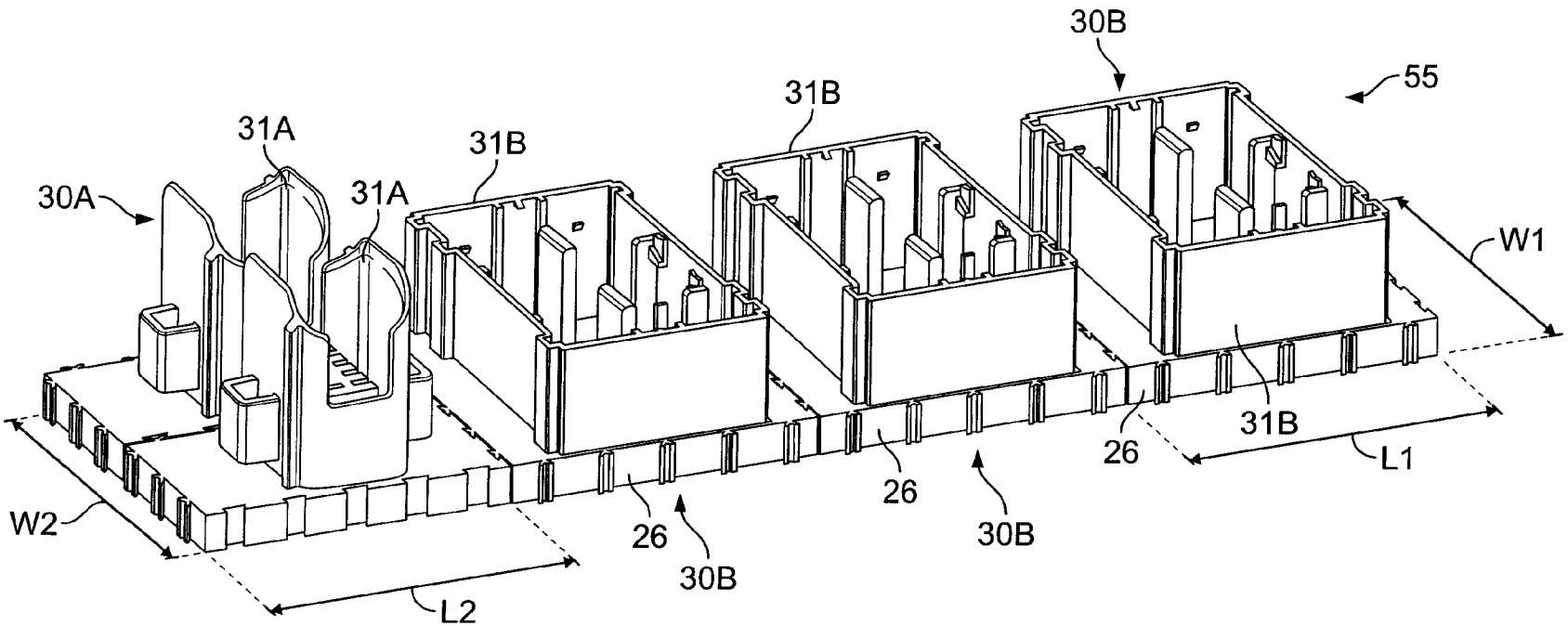

FIGS. 7A and 7B show perspective views of a plurality of modules of the modular housing, which includes at least one connector module 30A having at least one socket 31A, and at least one module 30B having at least one socket 31B. The sockets 31A, 31B are configured to correspond to the I/O connections of the printed circuit board. Referring to FIG. 7A, the connector modules 30A of the lower modules may have a length L2 and width W2 equal to the length L1 and width W1 of the repeatable plate 26 of the upper face 27. In another embodiment, the connector module 30A of the lower modules 55 may have a width equal to half the width W1 of the repeatable plate 26 of the upper face 27; yet have a length equal to the length L1 of the repeatable plate 26 of the upper face 27. It is noted that other dimensions for the connector modules 30A, have been contemplated, where the dimensions of the connector modules 30A are selected to provide a repeatable unit that is compatible in a housing assembly with the repeatable plate 26 of the upper face 27. Similar to the upper plate 26 of the upper face 27, the connector modules 30A, include interlocking tabs for engaging adjacent connector modules in reversible interlocking engagement, as shown in FIG. 7B.

Figure 7C:
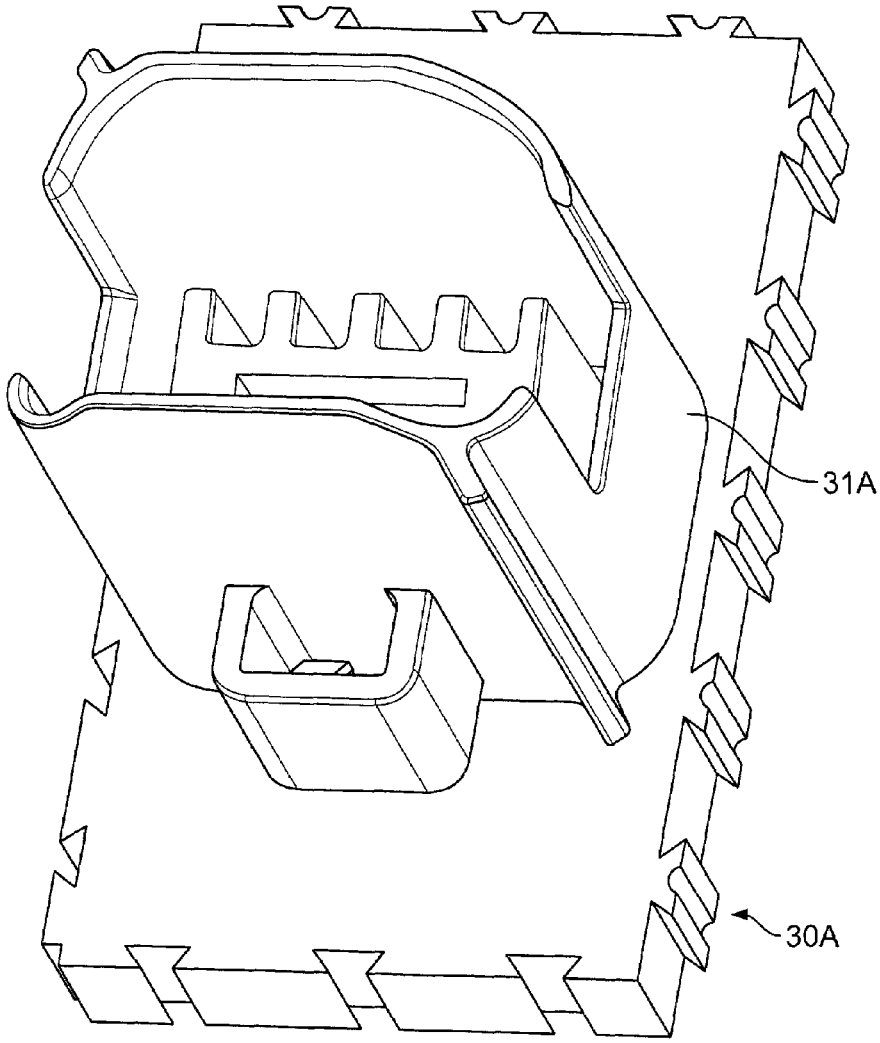
Figure 7D:
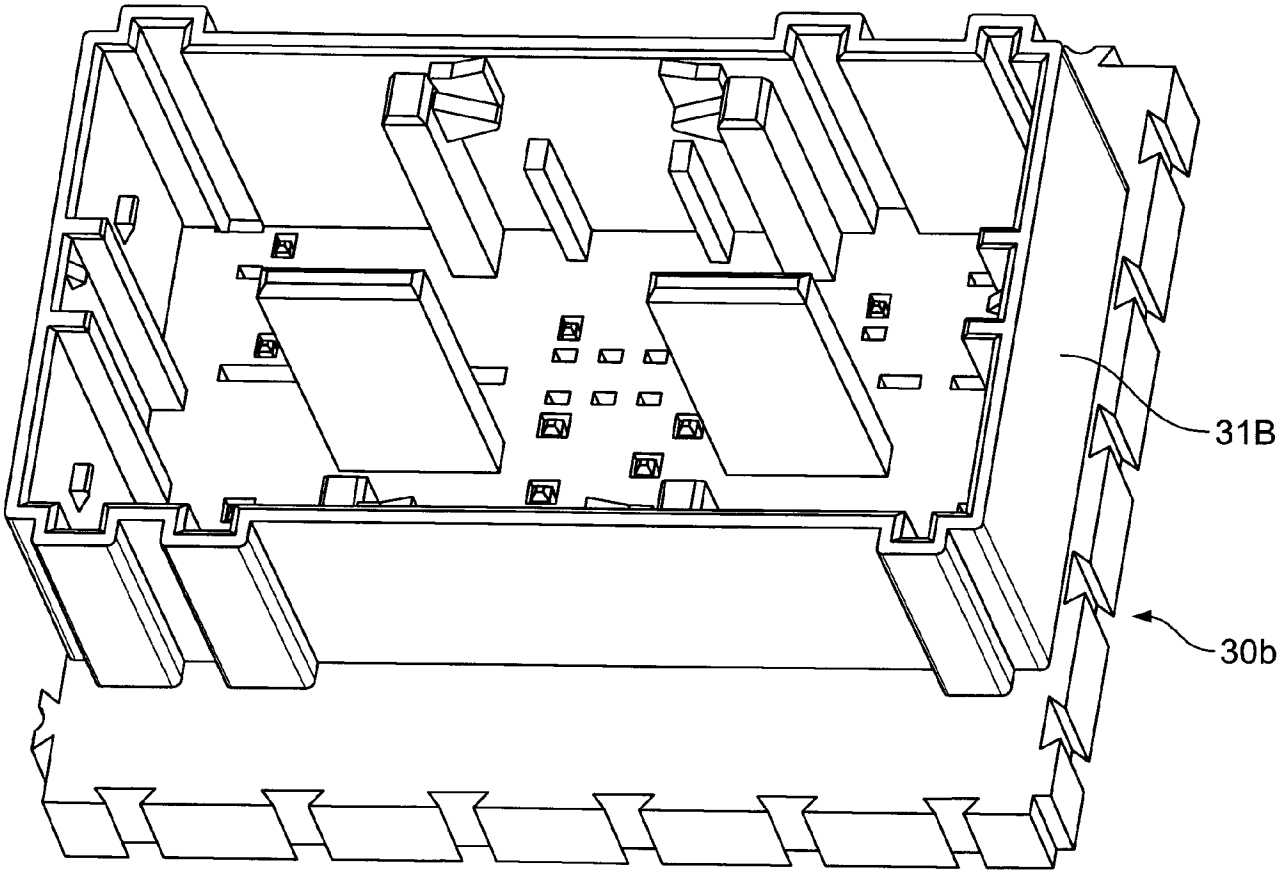

Referring to FIG. 7A, the connector modules 30A and modules 30B may include at least one socket 31A and/or 31B, respectively. The socket 31A of the connector module 30A can have a geometry that accepts a 14.5 mm power blade connector, as shown in FIG. 7C. In another embodiment the socket 31B of the connector module 30B can have a geometry that provides up to four different polarities and may be referred to as a 40-way connector module, as shown in FIG. 7D. FIGS. 8A and 8B show the assemblage of the upper face 27 and lower connector modules 55 of the modular housing with the modular power buss 10 and printed circuit boards 23, 24. In another embodiment, and as noted above, a single printed circuit board can be substituted for the two printed circuit boards. There is no limitation to the size of the connector or the number of connectors that can be connected to any one individual connector plate provided the component or components fit within the designated area.

Figure 9A:
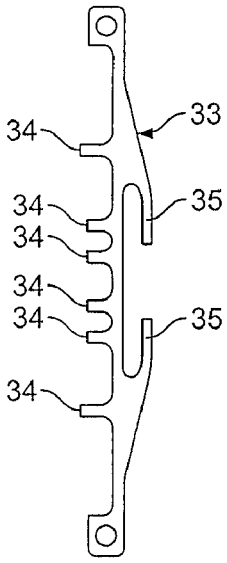
FIG. 9A is a side cross section view of one embodiment of the housing sidewall of the modular power distribution center.

FIG. 9A shows a side cross sectional view of the modular housing sidewalls 33. The sidewalls 33 of the modular housing can include interior guide rails 34 (which may also be referred to as slots) that provide support for the edges of the modular housing's upper face 27, lower modules 55, and the printed circuit boards 23, 24, or a single printed circuit board 21A as shown in FIG. 5E. The sidewalls 33 may also include an exterior guide rail 35 to facilitate assembly of the modular housing. The sidewalls 33 can be composed of an extruded plastic, stamped or extruded metal or any other material, where the profile of the sidewall is selected to provide interior and exterior guide rails 34, 35. Referring to FIG. 9B, the sidewalls 33 of the housing may be cut at the point of assembling the modular power distribution center, where the length of the rails are selected to correspond substantially to the upper 27 and lower modules 55 of the housing, as well as the electrical device and electrical system connector layout.

Figure 9C:
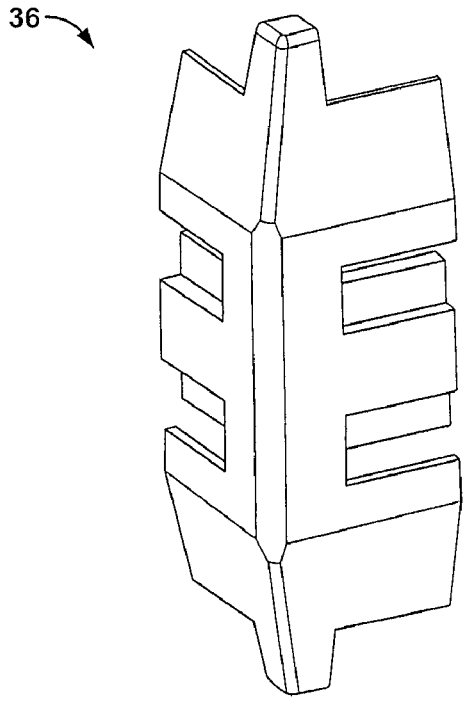
FIG. 9C is a perspective view of the corner connector for the sidewalls.
Figure 9D:
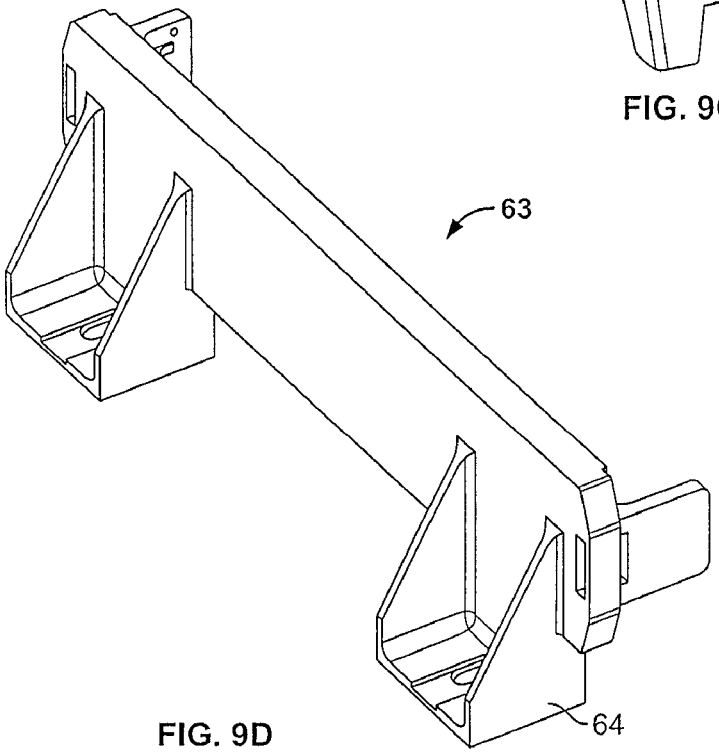
FIG. 9D is a perspective view of the outside surface of an end cap for the sidewalls.
Figure 9B:
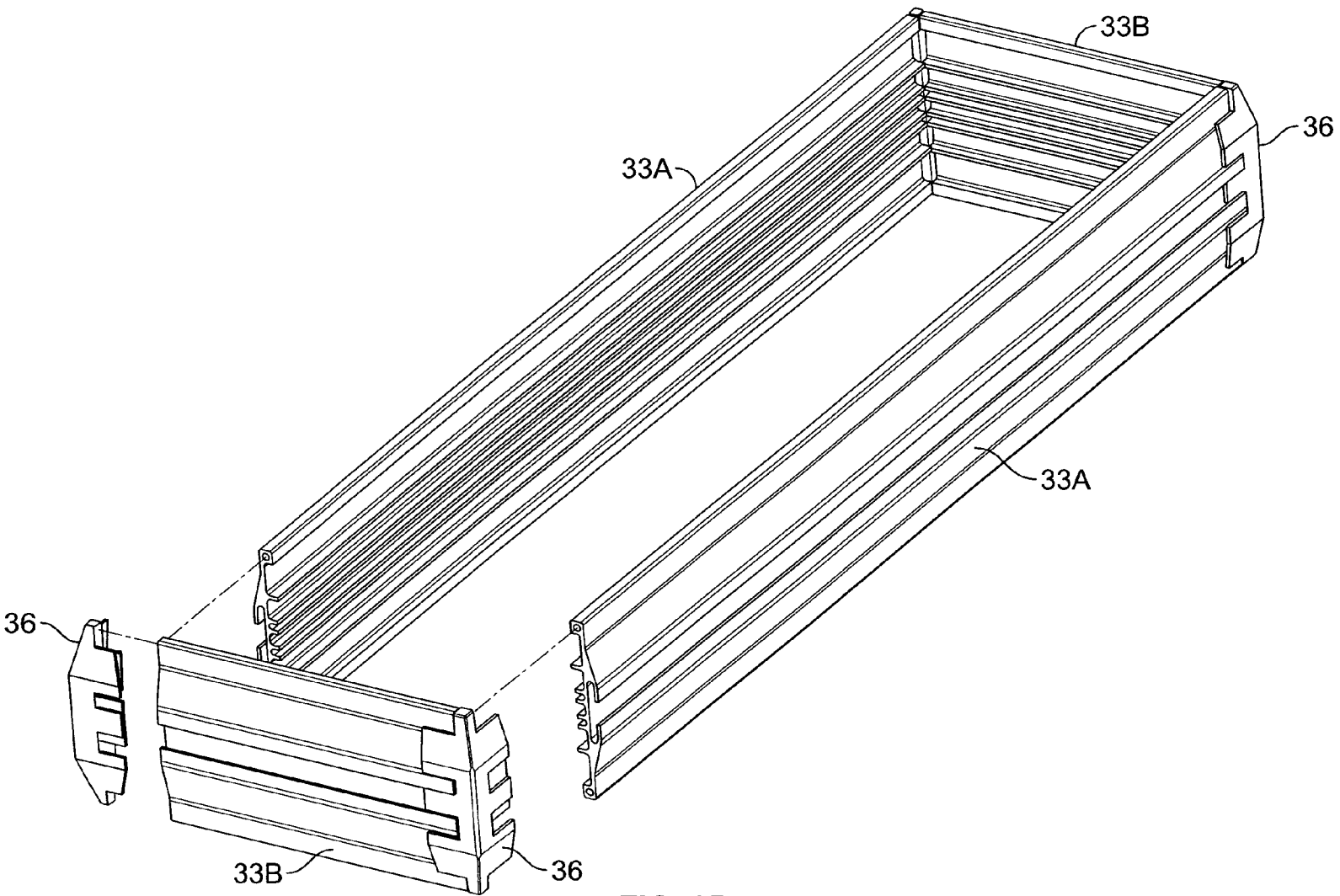
FIG. 9B is a perspective view of one embodiment of the housing corner connectors of the modular power distribution center.
Figure 9E:
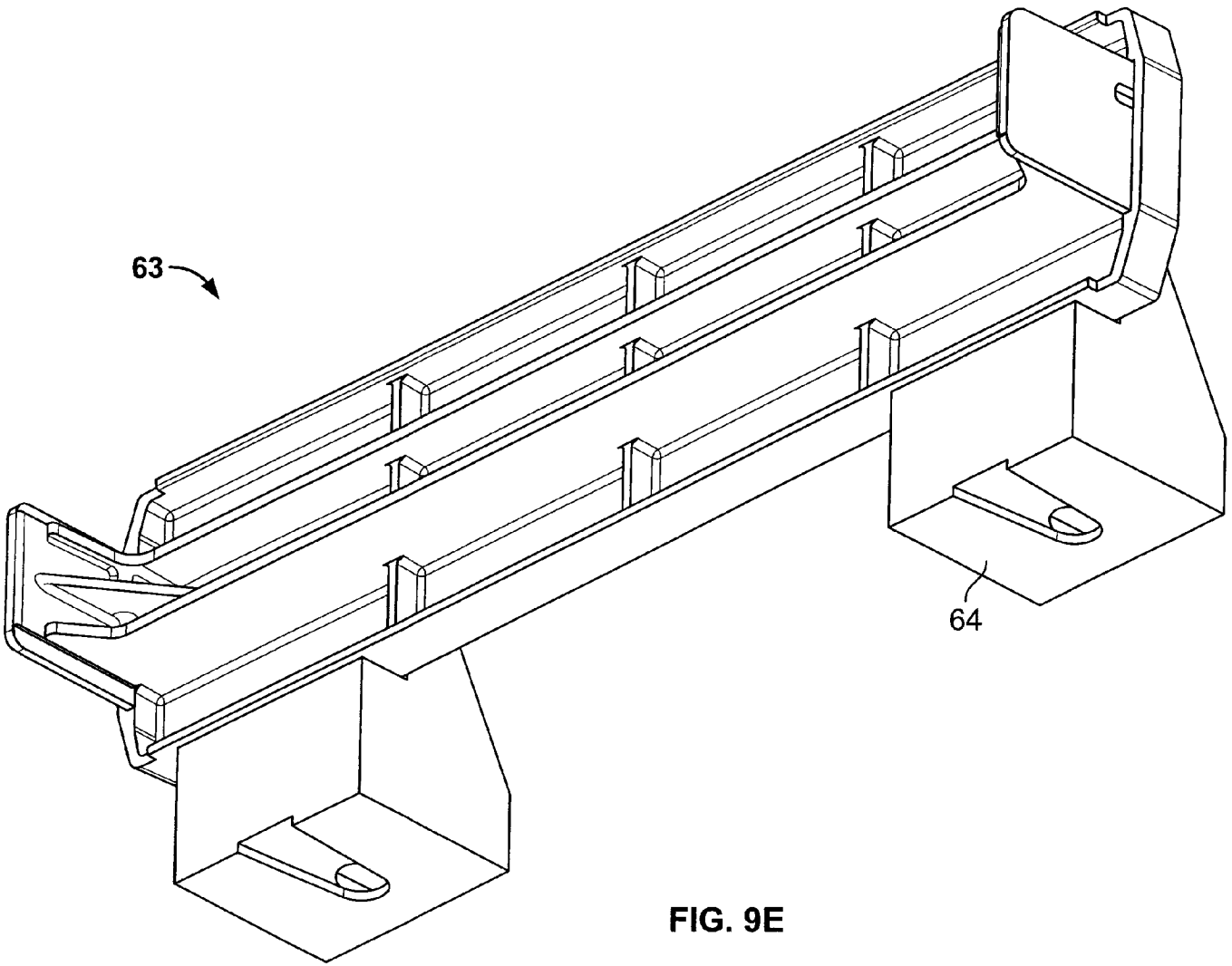
FIG. 9E is a perspective view of the inside surface of the end cap of FIG. 9E.

Referring to FIGS. 9B and 9C, the sidewalls 33 of the housing include sidewalls 33A each having a relatively long length and sidewalls 33B each having a relatively short length. The sidewalls 33A, 33B may be connected by a corner connector 36 (shown in more detail in FIG. 9C) having a geometry for engaging the sidewalls' 33A, 33B profiles, where the corner connector 36 engages the exterior guide rails 35 of the sidewalls 33. The corner connector 36 can be composed of a molded material, such as plastic, a cast structure, etc. Alternatively, as opposed to a corner connector 36 which is positioned at each corner of the housing, as shown in FIGS. 9B and 9C, two end caps 63 as shown in FIGS. 9D and 9E can be positioned at opposing ends of the housing. Provisions such as mounting brackets 64 for mounting the entire device can be integrated into the end caps or guide rails. FIG. 9D is a perspective view of the outside surface of the end cap, and FIG. 9E is a perspective view of the inside surface of the end cap.

Figure 10A:
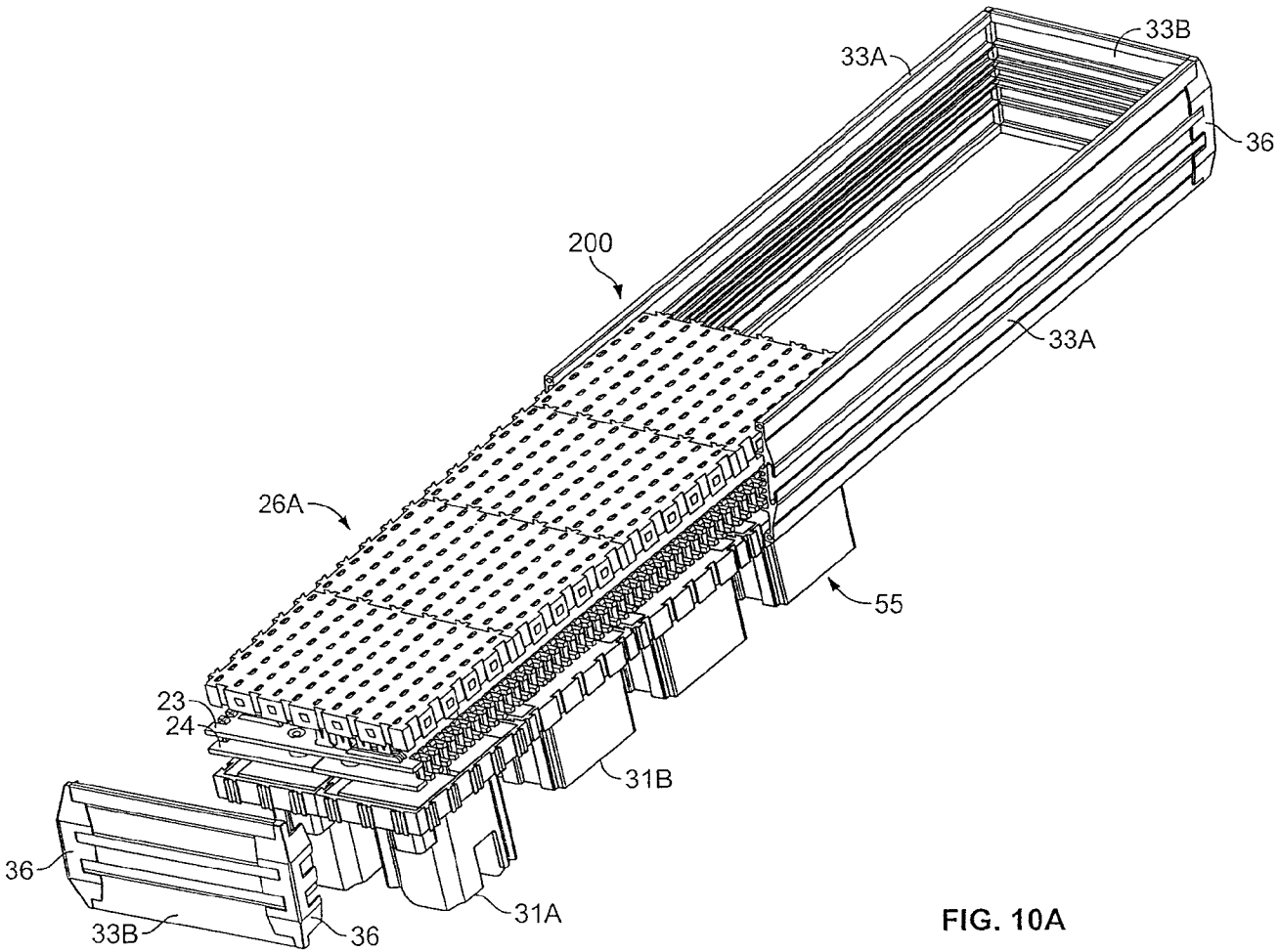
FIGS. 10A-10C are perspective views of one embodiment of an assembled modular distribution center.
Figure 10B:
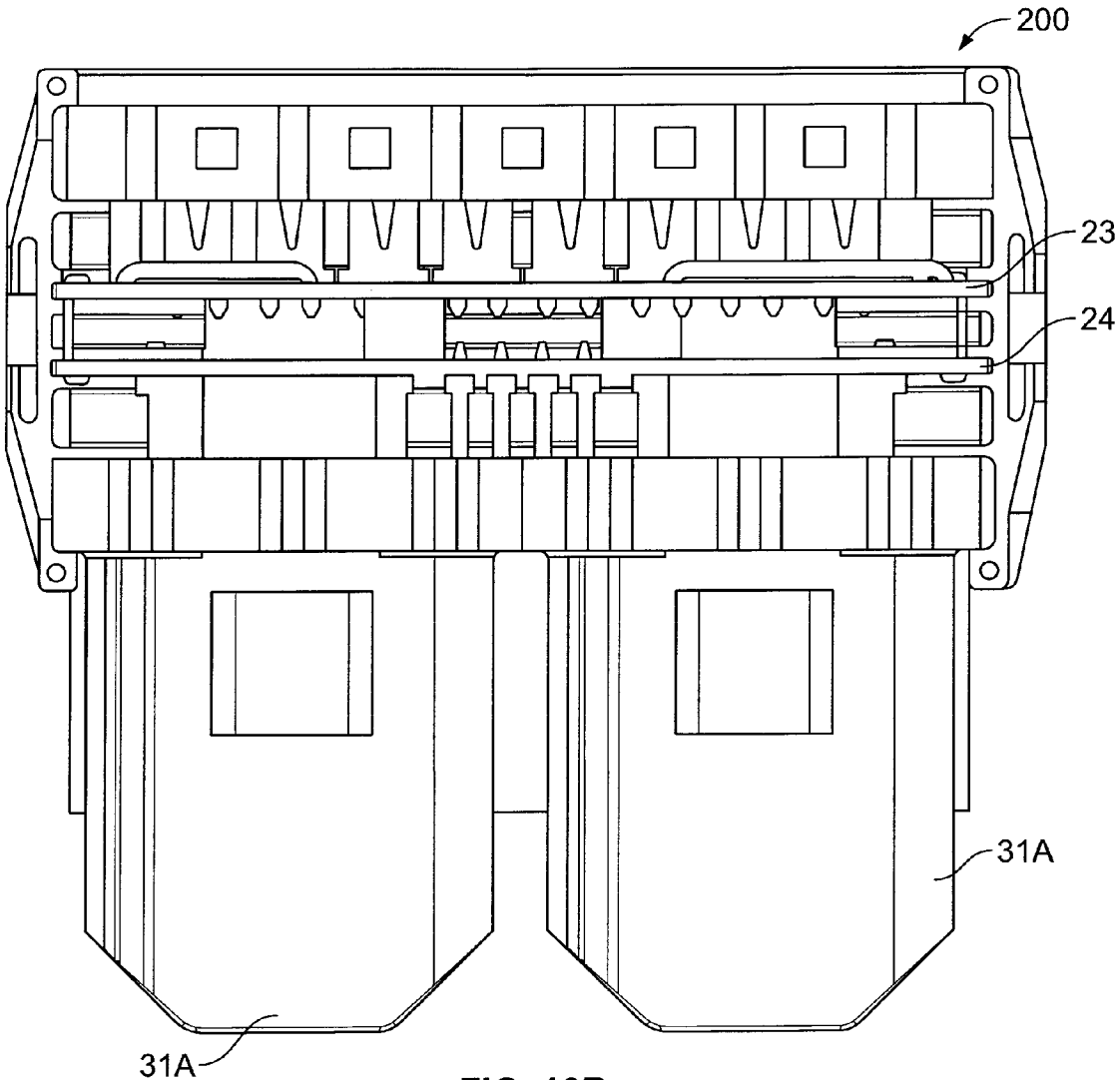
Figure 10C:
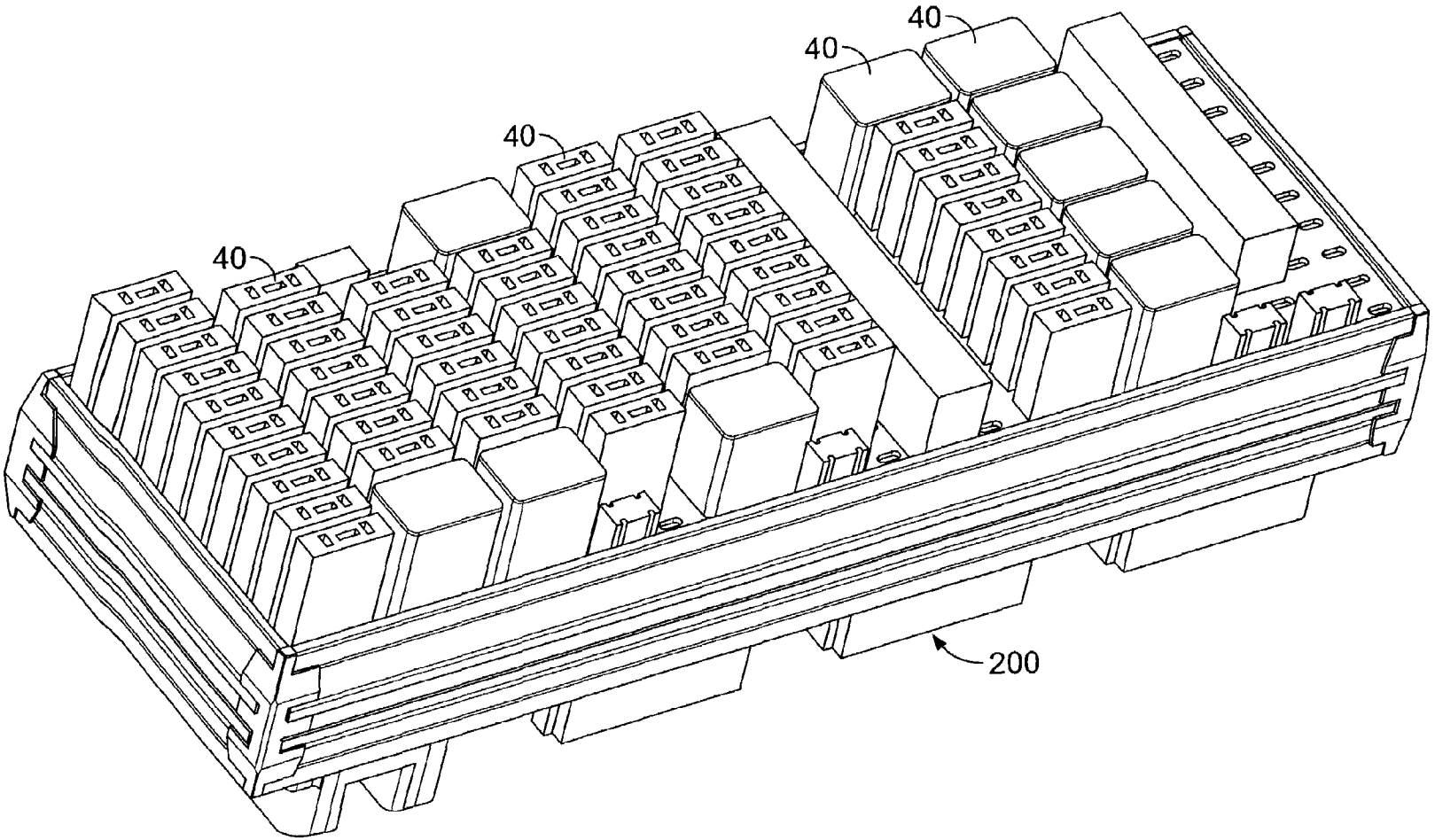

FIGS. 10A-10C, show an assembled modular distribution center 200. FIG. 10A shows the sliding engagement of the upper face and lower face 27, 29 of the modular housing and two printed circuit boards 23, 24 in modular housing sidewalls 33A, 33B. FIG. 10B shows a side cross section view of a power distribution center 200. FIG. 10C shows an assembled modular distribution center 200 having electrical devices 40, including but not limited to relays, fuses and circuit breakers, electrically connected to the device interface buss of the modular power distribution center 200 through the receptacle portions of the modular power distribution center's upper face. In another embodiment, the side extrusions can be snapped onto the top and bottom plates. In addition, the device interface buss can be replace with other types of device interfaces as for example, fork terminals, blade terminals, receptacle terminals, etc.

The modular power distribution center 200 and method for distributing electrical power advantageously allows for the use of mechanical connectors which eliminates the need for heavy gauge wire routing. The present invention further provides an easily adjustable system of modular device bussing (also referred to as primary bussing), which eliminates the need for customized buss bars. Additionally, the modular plates 26 and connectors 30A, 30B that provide the upper and lower faces 27, 29 of the housing in combination with the adjustability of the primary buss 10 provides a flexible platform that improves efficiency in electrical system connector and device placement. The plastic or metal, such as aluminum sidewalls advantageously provide continuous mounting surfaces for the upper and lower faces of the modular housing as well as the printed circuit board or boards encased within the housing. Further, the integration of printed circuit boards allows for adjustments in the routing of electrical devices and connecting structures without requiring substantial changes in tooling.

While there has been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

What is claimed is:

1. A modular power distribution center comprising:

a network of conductive paths having a plurality of I/O connections adapted to be coupled to electrical devices, each of the electrical devices having at least two terminals;

at least one power distribution buss conductively coupled to the network of conductive paths and adapted to be conductively coupled to a source of battery positive power;

at least two non-conductive plates of positioned on a top surface of the network of conductive paths, the at least two non-conductive plates being arranged in a grid;

each of the at least two non-conductive plates having cavity portions which extend therethrough, the cavity portions are arranged in a pattern adapted to receive the electrical devices on a top surface of each of the at least two non-conductive plates and are aligned with device terminal interfaces conductively coupled to the network of conductive paths.

2. The modular power distribution center of claim 1 wherein the power distribution buss comprises:

at least one primary buss conductively coupled to the network of conductive paths and adapted to be coupled to the source of battery power;

a primary strip of conductive material coupled to the at least one primary buss;

a first device interface buss of conductive material coupled through the primary strip to the primary buss;

at least one of the plurality of I/O connections conductively coupled to the device interface buss; and a second device interface buss conductively coupled through the network of conductive paths to at least another of the plurality of I/O connections.

3. The modular power distribution center of claim 1 further comprising a sidewall member coupled to at least one side of each of the at least two non-conductive plates.

4. The modular power distribution center of claim 3 wherein the sidewall member is composed of a rigid material.

5. The modular power distribution center of claim 3 wherein the sidewall member includes an outer surface having a guide rail.

6. The modular power distribution center of claim 3 wherein the sidewall member includes an inner surface having a guide rail.

7. The modular power distribution center of claim 1 wherein the at least two non-conductive plates are coupled together with interlocking members.

8. The modular power distribution center of claim 1 wherein at least one of the electrical devices is inserted into two of the cavity portions so as to bridge a seam between the at least two non-conductive plates.

9. The modular power distribution center of claim 1 wherein the network of conductive paths comprises a flexible printed circuitry.

10. The modular power distribution center of claim 1 wherein the network of conductive paths comprises insulated conductors selectively interconnected.

11. The modular power distribution center of claim 1 wherein the network of conductive paths comprises at least one printed circuit board.

12. The modular power distribution center of claim 2 wherein the network of conductive paths comprises:

at least one printed circuit board and the primary buss and the primary strip of conductive material are incorporated into conductive routing of the printed circuit board.

13. The modular power distribution center of claim 1 further comprising:

an electronics module located adjacent to and in electrical communication to the network of conductive paths.

14. The modular power distribution center of claim 1 wherein the electrical devices are selected from the group consisting of fuses, relays, resistors, diodes, and switches.

15. The modular power distribution center of claim 1 wherein the grid of cavity portions is configured for 280 series pitch, spacing and multiples thereof.

16. The modular power distribution center of claim 1 wherein the network of conductive paths comprises at least one connector module, wherein the at least one connector module comprises the at least one socket corresponding to the I/O connections of the network of conductive paths.

17. The modular power distribution center of claim 3, further comprising a molded unit, and wherein the sidewall member comprises at least two members, one of which is coupled to one side of each of the at least two non-conductive plates and the other of which is coupled to another side of each of the at least two non-conductive plates, the molded unit having a geometry for engagement with the at least two members.

18. The modular power distribution center of claim 2 wherein the first device interface buss comprises a 280 series buss strip.

19. A modular power distribution center comprising:

a network of conductive paths having a plurality of I/O connections adapted to be coupled to an electrical device having at least two terminals;

at least one power distribution buss conductively coupled to the network of conductive paths and adapted to be conductively coupled to a source of battery positive power;

at least two non-conductive plates positioned on a top surface of the network of conductive paths, the at least two non-conductive plates being arranged in a grid;

cavity portions which extend through each of the at least two non-conductive plates and are arranged in a pattern adapted to receive the electrical device on a top surface of each of the at least two non-conductive plates and are aligned with device terminal interfaces coupled to the network of conductive paths; and at least one sidewall member coupled to at least one side edge of each of the at least two non-conductive plates;

wherein the sidewall member supports the at least two non-conductive plates.

20. The modular power distribution center of claim 19 wherein the at least two non-conductive plates are coupled together with interlocking members.

21. The modular power distribution center of claim 19 wherein the electrical device is inserted into two of the cavity portions so as to bridge a seam between the at least two non-conductive plates.

22. The modular power distribution center of claim 19 wherein the network of conductive paths comprises at least one printed circuit board.

23. The modular power distribution center of claim 19 wherein the electrical device is selected from the group consisting of fuses, relays, resistors, diodes, and switches.

24. The modular power distribution center of claim 19 wherein the cavity portions are configured for 280 series pitch, spacing and multiples thereof.

25. The modular power distribution center of claim 19 wherein the network of conductive paths comprises at least one connector module, wherein the at least one connector module comprises at least two cavity portion I/O connections of the network of conductive paths.

26. A modular power distribution center comprising:

a network of conductive paths having a plurality of I/O connections adapted to be coupled to an electrical device having at least two terminals;

at least one power distribution buss conductively coupled to the network of conductive paths and adapted to be conductively coupled to a source of battery positive power;

at least two non-conductive plates positioned on a top surface of the network of conductive paths, the at least two non-conductive plates being arranged in a grid;

each of the at least two non-conductive plates having cavity portions which extend therethrough, the cavity portions are arranged in a pattern adapted to receive the electrical device on a top surface of each of the at least two non-conductive plates and are aligned with device terminal interfaces that are coupled to the network of conductive paths;

at least one connector module; and at least one sidewall member coupled to at least one side edge of the connector module;

wherein the sidewall member supports the connector module.

27. The modular power distribution center of claim 26 wherein the at least two non-conductive plates are coupled together with interlocking members.

28. The modular power distribution center of claim 26 wherein the at least two non-conductive plates form at least one seam therebetween and the electrical device is inserted into two of the cavity portions so as to bridge the at least one seam between the at least two non-conductive plates.

29. The modular power distribution center of claim 26 wherein the network of conductive paths comprises at least one printed circuit board.

30. The modular power distribution center of claim 26 wherein the electrical device is selected from the group consisting of fuses, relays, resistors, diodes, and switches.

31. The modular power distribution center of claim 26 wherein the grid of cavity portions is configured for 280 series pitch, spacing and multiples thereof.

32. The modular power distribution center of claim 26 wherein the network of conductive paths comprises at least one connector module, wherein the at least one connector module comprises at least two cavity portions corresponding to the I/O connections of the network of conductive paths.

33. A method for distributing electrical power comprising the steps of:

providing a power buss having a positive battery terminal and at least one device terminal interface having device connections;

connecting the power buss to at least one network of conductive paths;

wherein the at least one network of conductive paths has at least one I/O connection; and enclosing the network of conductive paths within a housing having at least two non-conductive modular plates arranged in a grid, each of the at least two non-conductive modular plates having a grid of cavity portions corresponding to the device connections of the at least one device terminal interface and at least one cavity portion corresponding to the at least one I/O connection of the network of conductive paths.

34. The method of claim 33 wherein providing a power buss further comprises:

providing a primary strip having a length along a first direction selected to provide electrical connection to at least the portion of the housing corresponding to the device connections;

connecting a battery positive terminal to the primary strip; and connecting at least one device interface buss to a portion of the primary strip, wherein the at least one device interface buss has a length along a second direction and is connected to a portion of the primary strip to provide a connection to the portion of the power distribution center corresponding to the device connections.

35. The method of claim 34 wherein the first direction is substantially perpendicular to the second direction.

36. The method of claim 34 further comprising the step of providing the at least one device interface buss with mechanical connection for receiving fuses, relays, resistors, diodes or switches.

37. The method of claim 34 further comprising mechanically connecting the battery positive terminal and the at least one device interface buss to the primary strip.

38. The method of claim 34 wherein the step of enclosing the network of conductive paths further comprises the step of:

providing a modular upper plate having the grid of cavity portions as a repeatable unit, wherein the number of the modular upper plates selected correspond to the device connection to the at least one device interface buss and the device connection to the power distribution center;

providing a modular lower plate having the at least one socket as a repeatable unit, wherein the number of modular lower plates selected correspond to the I/O connections of the printed circuit board and the I/O connections to the power distribution center.

39. The method of claim 38 further comprising the step of providing sidewalls for engaging the at least two non-conductive modular plates.

* * * * *